US012084937B2

(12) United States Patent
Bartlett et al.

(10) Patent No.: US 12,084,937 B2
(45) **Date of Patent: *Sep. 10, 2024**

(54) BARRIER ARRANGEMENT IN WELLHEAD ASSEMBLY

(71) Applicant: Dril-Quip, Inc., Houston, TX (US)

(72) Inventors: Chris D. Bartlett, Spring, TX (US); Daniel J. McLaughlin, Katy, TX (US); Raymond A. Guillory, Houston, TX (US); Blake T. DeBerry, Houston, TX (US); Marcus Smedley, Houston, TX (US); Gregory K. Norwood, Boerne, TX (US); David A. Scantlebury, Missouri City, TX (US); Andrew B. Mitchell, Houston, TX (US); Darren W. Mills, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/453,649

(22) Filed: Aug. 22, 2023

(65) Prior Publication Data

US 2023/0392466 A1 Dec. 7, 2023

Related U.S. Application Data

(63) Continuation of application No. 17/889,232, filed on Aug. 16, 2022, now Pat. No. 11,773,678, which is a (Continued)

(51) Int. Cl.

| | |
|---|---|
| ***E21B 33/035*** | (2006.01) |
| ***E21B 33/038*** | (2006.01) |
| ***E21B 33/043*** | (2006.01) |

(52) U.S. Cl.
CPC ..... *E21B 33/0355* (2013.01); *E21B 33/038* (2013.01); *E21B 33/043* (2013.01)

(58) Field of Classification Search
CPC ... E21B 33/0355; E21B 33/038; E21B 33/043
See application file for complete search history.

(56) References Cited

U.S. PATENT DOCUMENTS 5,971,077 A * 10/1999 Lilley ..... E21B 43/013 166/368
5,992,527 A * 11/1999 Garnham ..... E21B 33/0353 166/88.4

(Continued)

FOREIGN PATENT DOCUMENTS

GB 2192921 A 1/1988

OTHER PUBLICATIONS

Examination Report issued in related Great Britain Patent Application No. GB2107482.8 dated Apr. 14, 2022, 5 pages.

(Continued)

*Primary Examiner* — Matthew R Buck
(74) *Attorney, Agent, or Firm* — Baker Botts L.L.P.

(57) ABSTRACT

A subsea wellhead assembly having an arrangement of primary well barriers provided in equipment that is located within the well and/or the wellhead housing is provided. The subsea wellhead assembly may include a tubing hanger positioned in or below a wellhead housing coupled to a subsea well, a tree cap fluidly coupled to the tubing hanger and disposed atop the wellhead housing, and a pair of master production valves configured to be selectively actuated from an open position to a closed position to shut in the subsea well, each of the pair of master production valves located within or below the wellhead housing.

16 Claims, 16 Drawing Sheets

Related U.S. Application Data continuation-in-part of application No. 17/299,435, filed as application No. PCT/US2019/064485 on Dec. 4, 2019, now Pat. No. 11,542,778.

(60) Provisional application No. 62/775,672, filed on Dec. 5, 2018.

(56) References Cited

U.S. PATENT DOCUMENTS 6,357,529 B1 * 3/2002 Kent ..... E21B 33/035 166/344
7,013,970 B2 * 3/2006 Collie ..... E21B 33/047 166/344
8,011,436 B2 * 9/2011 Christie ..... E21B 33/038 166/85.1
8,881,827 B2 * 11/2014 Bjerke ..... E21B 33/043 166/347
8,955,594 B2 * 2/2015 Bell ..... E21B 33/035 166/341
9,702,212 B2 * 7/2017 Breda ..... E21B 33/0385
10,240,424 B2 * 3/2019 Brown ..... E21B 33/035
10,808,483 B2 * 10/2020 Hosie ..... E21B 33/035
11,162,317 B2 * 11/2021 Zaragoza Labes ..... E21B 34/04
11,542,778 B2 * 1/2023 Bartlett ..... E21B 33/038
11,773,678 B2 * 10/2023 Bartlett ..... E21B 33/0355 166/344
2010/0071775 A1 3/2010 Ratcliffe
2012/0138159 A1 6/2012 Wordley et al.
2014/0060850 A1 3/2014 Voss et al.
2014/0299328 A1 * 10/2014 Ray ..... E21B 34/04 166/360
2017/0089182 A1 3/2017 Witwer et al.
2017/0211355 A1 7/2017 Maher
2018/0283124 A1 10/2018 Hosie et al.

OTHER PUBLICATIONS

International Search Report and Written Opinion issued in related PCT Application No. PCT/US2019/064485 mailed Mar. 23, 2020, 10 pages.
International Preliminary Report on Patentability issued in related PCT Application No. PCT/US2019/064485 mailed Jun. 17, 2021, 7 pages.

* cited by examiner

BARRIER ARRANGEMENT IN WELLHEAD ASSEMBLY

CROSS-REFERENCE TO RELATED APPLICATIONS

The present application is Continuation of U.S. patent application Ser. No. 17/889,232 filed on Aug. 16, 2022, which is a Continuation-in-Part of U.S. patent application Ser. No. 17/299,435 filed on Jun. 3, 2021, which is a U.S. National Stage Application of International Application No. PCT/US2019/064485 filed Dec. 4, 2019, which claims priority to U.S. Provisional Application Ser. No. 62/775,672 filed on Dec. 5, 2018, all of which are incorporated herein by reference in their entirety for all purposes.

TECHNICAL FIELD

The present disclosure relates generally to wellhead systems and, more particularly, to an improved arrangement of well barriers in a wellhead assembly.

BACKGROUND

Conventional wellhead systems include a wellhead housing mounted on the upper end of a subsurface casing string extending into the wellbore. During a drilling procedure, a drilling riser and BOP are installed above a wellhead housing (casing head) to provide pressure control as casing is installed, with each casing string having a casing hanger on its upper end for landing on a shoulder within the wellhead housing. A tubing string is then installed through the wellbore. A tubing hanger connectable to the upper end of the tubing string is supported within the wellhead housing above the casing hanger(s) for suspending the tubing string within the casing string(s). Upon completion of this process, the well is temporarily suspended via a temporary barrier. The temporary barrier could be a wireline plug, a downhole isolation valve that is pressure cycled open, a downhole safety valve, heavy completion fluid, or any combination of the above. The temporary barrier will provide a barrier between the well and the environment prior to the well control devices, such as the blowout preventer (BOP) and marine riser, being disconnected from the well.

Once removed, the BOP is replaced by a permanent well control device, in the form of a subsea Christmas tree installed above the wellhead housing, with the tree having a valve to enable the oil or gas to be produced and directed into flow lines for transportation to a desired facility. The temporary well barriers are removed after the subsea tree is installed. The subsea tree then acts as the primary well control device while the tree is in production. The subsea tree has at least two well barriers in the production flowbore that allow the well to be remotely shut in if there is a situation on the platform or anywhere downstream of the tree that requires isolation of the well.

In the event that the subsea tree needs to be retrieved, one or more temporary barriers is re-installed into the well. This is typically accomplished by installing a running string and/or riser that allows for heavy completion fluid to be pumped into the wellbore, and a wireline plug is installed into the tubing hanger. Once these barriers are in place, the subsea tree may be removed. If an isolation valve that actuates closed by means of applying pressure cycles (e.g., full-bore isolation valve, or FBIV) is used during the initial installation, it cannot be shifted closed again remotely. As such, a different barrier will be installed in place of the FBIV, typically a wireline plug.

This process of setting additional barriers in the flowbore before retrieving a subsea tree from the wellhead is time consuming and expensive. It is now recognized that systems and methods to simplify or reduce the cost of such wellhead installation/servicing operations is desired.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business-related constraints, which will vary from one implementation to another. Moreover, it will be appreciated that such a development effort might be complex and time consuming but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to a wellhead assembly having an arrangement of primary well barriers provided in equipment that is located within the well and/or the wellhead housing. Specifically, all of the well barriers may be located within the tubing hanger and/or the production tubing string extending into the wellbore.

By including all the main well barriers within the tubing hanger and/or production tubing string, the "tree" that would otherwise be placed atop the wellhead will be greatly simplified. The "tree" portion of the wellhead assembly located atop the wellhead housing essentially functions as a well cap, or flowline connection body. As such, in disclosed embodiments, the term "tree" will be used to refer to a flowline connection body. This transformation of the "tree" into simply a flowline connection body means that this piece of equipment does not have to meet the code requirements for a subsea Christmas tree, but instead only has to meet flowline code requirements, which are different and less stringent than those of a subsea tree.

The "tree" in presently disclosed embodiments does not include any primary barriers that can be used to shut in the wellbore if there is a situation on the platform or anywhere downstream of the tree that requires isolation of the well. The wellhead assembly and associated components will include at least two such barriers for the production flowbore, but they will be located either within or upstream of the tubing hanger. There are numerous potential configurations of the equipment that facilitate movement of the primary well barriers from the subsea tree to other pieces of equipment at or below the wellhead. Example embodiments of improved barrier arrangements within the wellhead assembly will be provided and described below with reference to FIGS. 1-3.

Figure 1:
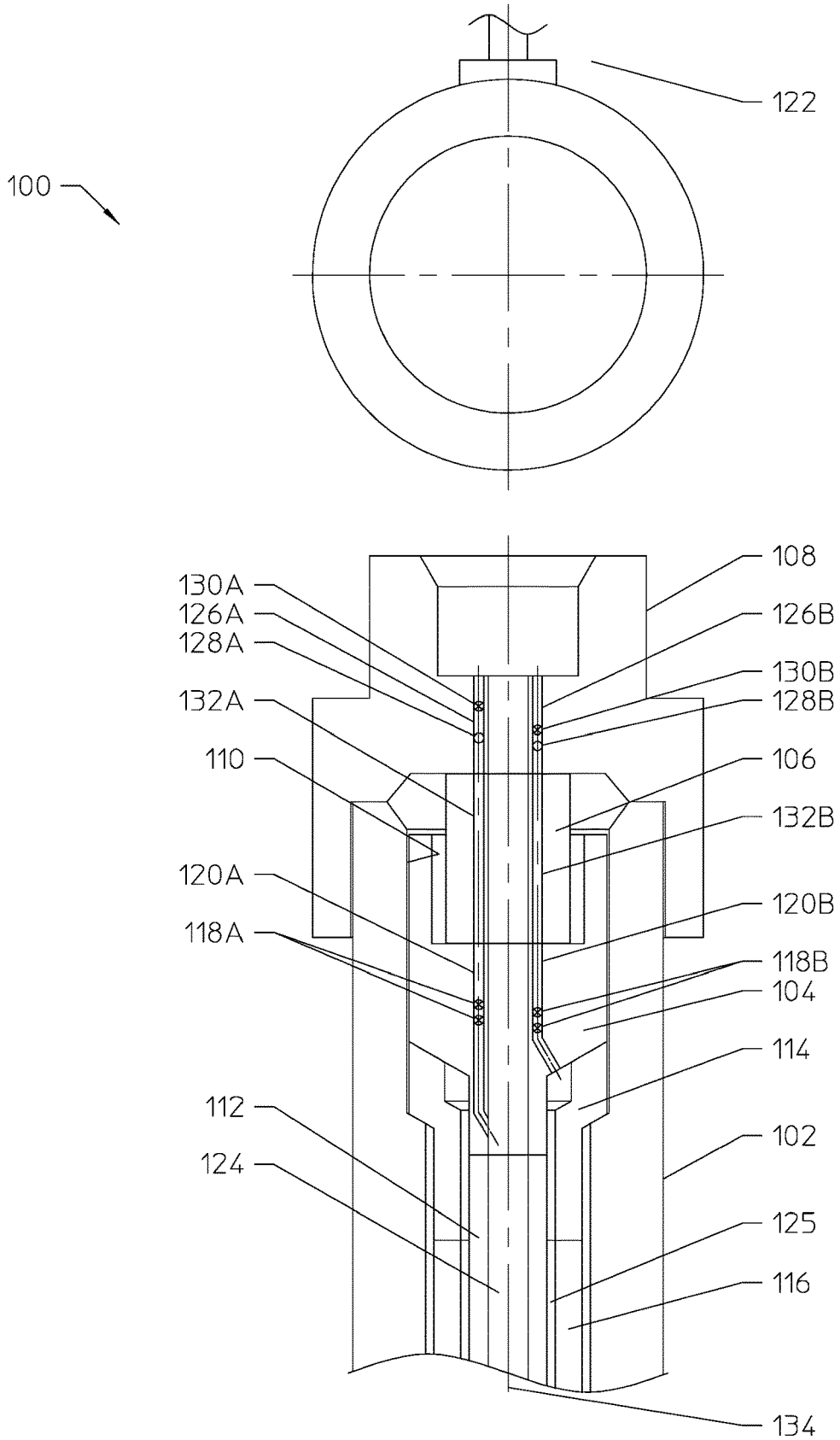
FIG. 1 is a partial cross sectional view of components of a subsea production system having an arrangement of well barriers within a tubing hanger, in accordance with an embodiment of the present disclosure.

Turning now to the drawings, FIG. 1 illustrates certain components of a subsea production system 100, which has the primary well barriers located within a tubing hanger below the "tree" (flowline connection body). The subsea production system 100 may include a wellhead 102, a tubing hanger 104, a tubing hanger alignment device 106, and a flowline connection body 108. The tubing hanger 104 may be landed in and sealed against a bore 110 of the wellhead 102, as shown. The tubing hanger 104 may suspend a production tubing string 112 into and through the wellhead 102. Likewise, one or more casing hangers 114 may be held within and sealed against the bore 110 of the wellhead 102 and used to suspend corresponding casing strings 116 through the wellhead 102 and the wellbore below. The flowline connection body 108 may be connected to and sealed against the wellhead 102.

In presently disclosed embodiments, the tubing hanger 104 may include at least two well barriers (in the form of valves) 118A that may be actuated to fluidly couple a production flowpath 120A through the tubing hanger 104 to one or more downstream production flowpaths, such as one or more flowpaths through the tubing hanger alignment device 106, the flowline connection body 108, and a downstream well jumper 122. The tubing hanger 104 may also include one or more well barriers (in the form of valves) 118B that may be actuated to fluidly couple an annulus flowpath 120B through the tubing hanger 104 to the one or more downstream annulus flowpaths.

In the illustrated embodiment, the production flowpath 120A through the tubing hanger 104 is coupled at an upstream end to a main production flowbore 124 of the production tubing string 112 below. As illustrated, the barrier valves 118A may include at least two valves disposed along this production flowpath 120A through the tubing hanger 104. In other embodiments, the barrier valves 118A may include at least one valve disposed along the production flowpath 120A through the tubing hanger 104 and at least one other valve disposed along the main production flowbore 124 below the tubing hanger 104.

In the illustrated embodiment, the annulus flowpath 120B through the tubing hanger 104 is coupled at an upstream end to an annulus 125 between the production tubing sting 112 and the innermost casing 116. As illustrated, the barrier valve(s) 118B may include two valves disposed along this annulus flowpath 120B through the tubing hanger 104. In other embodiments, the barrier valve(s) 118B may include just one valve 118B disposed along the annulus flowpath 120B through the tubing hanger 104. In still other embodiments, the barrier valve(s) 118B may include at least one valve 118B disposed along the annulus flowpath 120B through the tubing hanger 104 and at least one annular valve disposed within the annulus 125 below the tubing hanger 104.

If an unexpected or undesired event occurs making it necessary to shut in the well, these barrier valves 118A and 118B may be actuated from an open position to a closed position to shut in the well. Conventional well systems generally include these primary barrier valves within a subsea tree located above the tubing hanger; however, the disclosed arrangement of these barrier valves 118 in the tubing hanger 104 (and/or below the tubing hanger 104) simplifies the construction, installation, and servicing of the "tree", which is the flowline connection body 108.

The barrier valves 118 may each include a ball valve, a flapper valve, a gate valve, an annular valve, or any desired types of valve capable of acting as a well barrier. The barrier valves 118 may be remotely actuatable so that they can be activated quickly to shut in the well as needed. Details of the controls used to actuate various valves within the disclosed subsea production system 100 are provided below with reference to FIGS. 2 and 3.

The flowline connection body 108 may include a production flowpath 126A and an annulus flowpath 126B extending therethrough to fluidly connect the flowpaths 120A and 120B, respectively, to the well jumper 122. Flowpaths 128A and 128B may extend horizontally from the vertical bores 126A and 126B to a well jumper connection interface. It should be noted that other relative orientations of these flowpaths 126 and 128 may be possible in other embodiments. The flowline connection body 108 may include one or more valves disposed therein, although these are not barrier valves capable of shutting in the well. For example, the flowline connection body 108 may include a production swab valve 130A located along the flowpath 126A, and an annulus swab valve 130B located along the flowpath 126B. The swab valves 130A and 130B allow vertical access into the production bore of the well; the swab valves 130A and 130B also facilitate a circulation flowpath during certain well conditioning operations.

As shown, the tubing hanger alignment device 106 may connect the flowline connection body 108 to the tubing hanger 104. The tubing hanger alignment device 106 may include a production flowpath 132A extending therethrough for fluidly connecting the flowpath 120A of the tubing hanger 104 to the flowpath 126A of the flowline connection body 108. The tubing hanger alignment device 106 may similarly include a production flowpath 132B extending therethrough for fluidly connecting the flowpath 120B of the tubing hanger 104 to the flowpath 126B of the flowline connection body 108. Although these flowpaths 132 are illustrated as being side by side in the cross-sectional view, it should be noted that in certain embodiments these flowpaths 132 through the tubing hanger alignment device 106 may be concentric, with one being a central flowpath and the other being an annular space surrounding the central flowpath. The tubing hanger alignment device 106 may further include one or more communication lines (e.g., hydraulic fluid lines, electrical lines, and/or fiber optic cables), which are not shown, disposed therethrough and used to communicatively couple the flowline connection body 108 to the tubing hanger 104.

The tubing hanger 104 may include couplings or stabs located at the top of the tubing hanger 104 in a specific orientation with respect to a longitudinal axis 134. The tubing hanger alignment device 106 is configured to facilitate a mating connection that communicatively couples the flowline connection body 108 to the couplings/stabs on the tubing hanger 104 as the flowline connection body 108 is landed onto the wellhead 102, regardless of the orientation in which the flowline connection body 108 is initially positioned during the landing process.

The disclosed subsea production system 100 allows for the flowline connection body 108 (or "tree", or well cap) to be installed and later retrieved without requiring certain steps to be performed. Specifically, when it is desired to retrieve the flowline connection body 108 for repairs or maintenance, this can be accomplished without providing a pressure containing conduit (e.g., marine riser) and installing wireline plugs to act as temporary well barriers. This is because the main well barriers 118 are already located within the equipment below the flowline connection body 108. If the flowline connection body 108 is to be removed, this is accomplished by first closing the barrier valves 118 in the tubing hanger 104 and/or the well so that the well is protected during the retrieval procedure.

By eliminating the relatively large well barriers from the "tree" (flowline connection body 108), this reduces the size, weight, and cost of the flowline connection body 108, as compared to existing systems having a subsea tree with the well barriers. The disclosed subsea production system 100 enables a simplified flowline connection body 108 to be used in place of this typical subsea tree. The simplified design of the flowline connection body 108 also allows for a simplified control system to be used with the subsea wellhead assembly.

Figure 2:
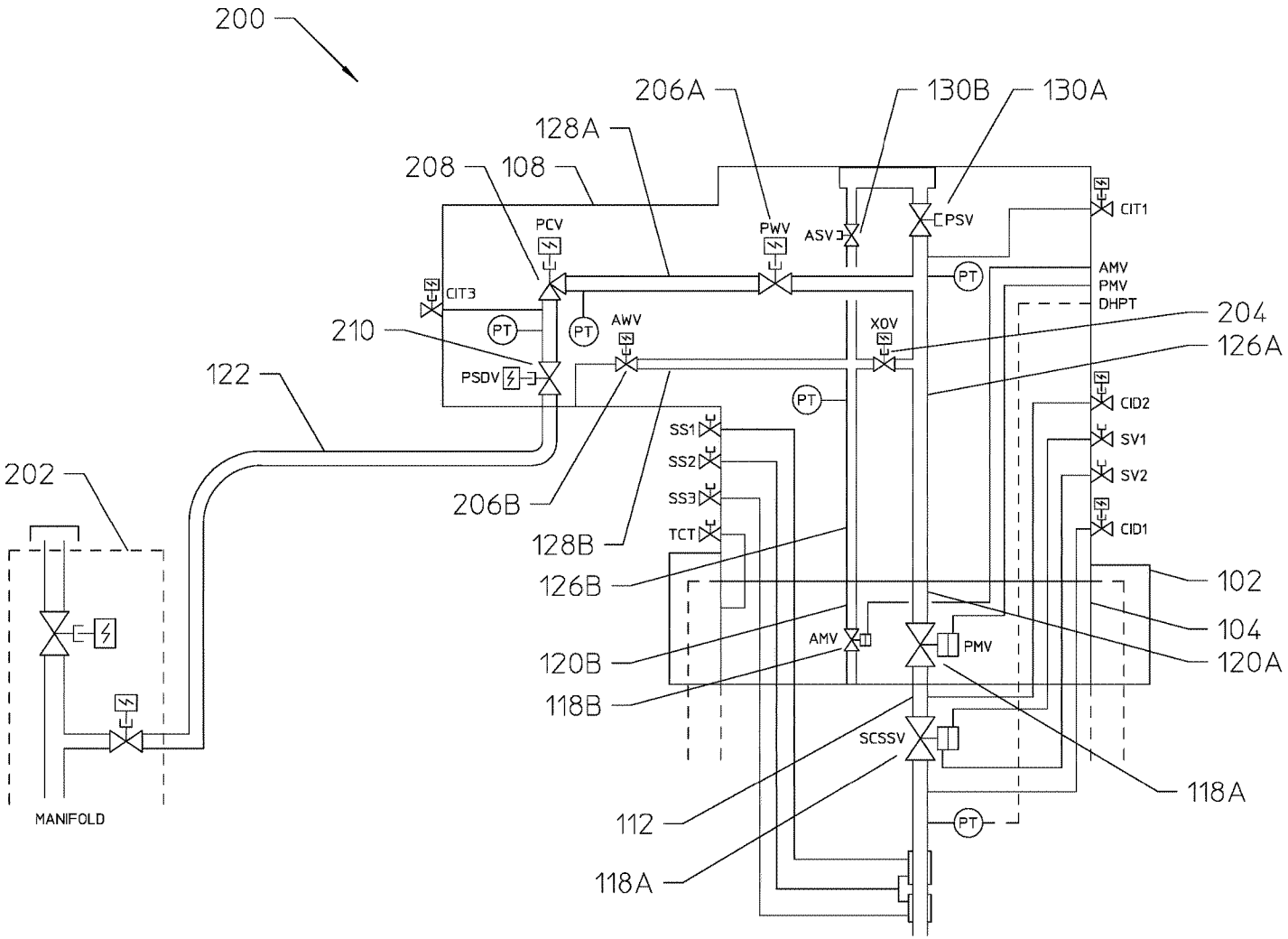
FIG. 2 is a schematic diagram of components of a subsea production system including a manifold and an arrangement of well barriers disposed in the wellhead, tubing hanger, and/or well completion string, in accordance with an embodiment of the present disclosure.

FIG. 2 is a schematic illustrating an embodiment of a subsea production system 200 with the improved arrangement of well barriers 118, which allows for more simplified controls for the wellhead assembly. The subsea production system 200 enables a streamlined process for retrieving the flowline connection body 108 if needed during production operations.

As illustrated, the flowline connection body 108 connects the production flowpath 120A through the tubing hanger 104 with the flowline jumper 122 that provides production fluid to a subsea production manifold 202. In this embodiment, one of the main barrier valves 118A (a production master valve, or PMV) is located along the production flowpath 120A within the tubing hanger 104. The other of the main barrier valves 118A (a surface controlled subsurface safety valve, or SCSSV) is located upstream of the tubing hanger 104 within the main flowbore of the production tubing string 112. The main annulus barrier valve 118B (an annulus master valve, or AMV) is located along the annulus flowpath 120B within the tubing hanger 104. As such, none of the main barrier valves 118 for the subsea production system 200 are located in the flowline connection body 108.

Although the flowline connection body 108 does not include the main barrier valves 118, the flowline connection body 108 may still include a number of additional valves that are held to lower code requirements. These valves may include, for example, a production swab valve (PSV) 130A and annulus swab valve (ASV) 130B, a crossover valve (XOV) 204 between the production flowpath 126A and the annulus flowpath 126B, a production wing valve (PWV) 206A and annulus wing valve (AWV) 206B, a pressure control valve (PCV) 208, and a process shut down valve (PSDV) 210. The swab valves 130 provide vertical access for wireline or coiled tubing operations as well as a circulation flowpath when intervention is required in the well. The XOV 204 allows fluid and/or pressure to be circulated or bled down from the annulus to the production flowpath 126A. The wing valves 206 are historically the most actively actuated valves that are operated with the intent of not wearing out the master valves. The PCV 208 controls the flowing pressure of the well, so that the well may be manifolded with other producing wells within the subsea system. The PSDV 210 is used as a sacrificial valve operated first or last in a sequence of operations to receive the wear and tear caused by any sand production through the system.

The disclosed streamlined subsea production system 200 may offer various advantages over existing subsea systems that have the main barrier valves located in a subsea tree above the wellhead. In the illustrated embodiment, the flowline connection body 108 has space for several valves to be disposed therein due to the space savings from having the main barrier valves 118 located elsewhere. By having all these valves (130, 204, 206, 208, and 210) located in the flowline connection body 108, this allows a single compact manifold 202 to be used for connecting the production flowline of the subsea system 200 to a topsides facility. Using the compact header manifold 202 reduces the size, complexity, and weight of the overall subsea production system 200, thereby reducing the time and cost for installation. The compact manifold 202 may be attached to the flowline connection body 108 via a flexible jumper 122, as opposed to a larger, more structured jumper assembly, thereby providing jumper installation savings. Having the PMV 118A in the tubing hanger 104 facilitates riser light well intervention (RLWI) access. Additionally, having the PMV 118A in the tubing hanger 104 eliminates the need for a full-bore isolation valve (FBIV) to be used during the initial installation of the wellhead assembly and allows for isolation of the main production flowbore during future interventions without setting a temporary plug.

Figure 3:
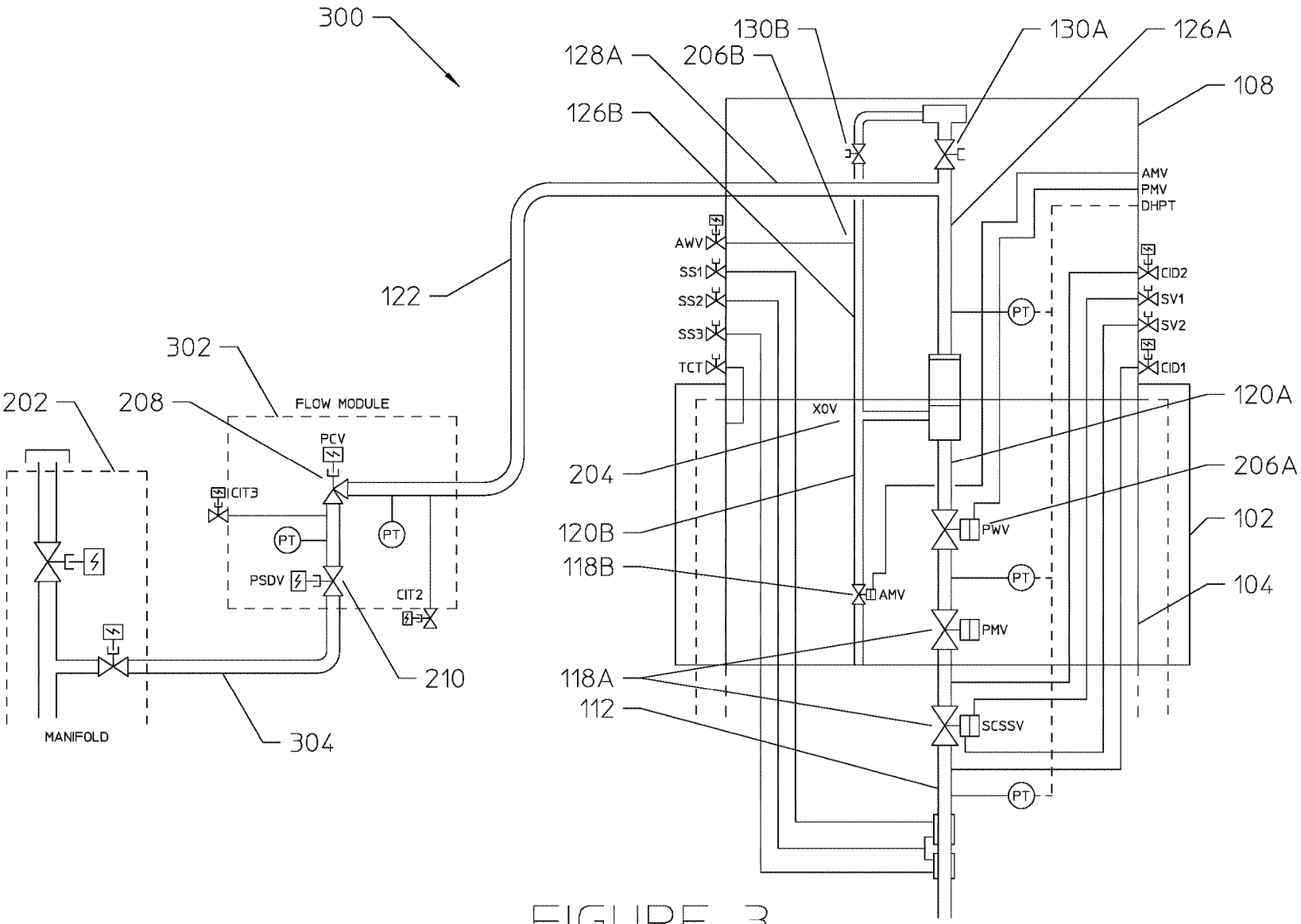
FIG. 3 is a schematic diagram of components of a subsea production system including a flow module, a manifold, and an arrangement of well barriers disposed in the wellhead, tubing hanger, and/or well completion string, in accordance with an embodiment of the present disclosure.

FIG. 3 is a schematic illustrating an embodiment of a subsea production system 300 with the improved arrangement of well barriers 118, which allows for more simplified controls for the wellhead assembly. The subsea production system 300 enables a streamlined process for retrieving the flowline connection body 108 if needed during production operations.

As illustrated, the flowline connection body 108 connects the production flowpath 120A through the tubing hanger 104 with the flowline jumper 122 that provides production fluid to a flow module 302, which then communicates production fluid through another jumper 304 to a subsea production manifold 202. In this embodiment, one of the main barrier valves 118A (PMV) is located along the production flowpath 120A within the tubing hanger 104. The other of the main barrier valves 118A (SCSSV) is located upstream of the tubing hanger 104 within the main flowbore of the production tubing string 112. The main annulus barrier valve 118B (AMV) is located along the annulus flowpath 120B within the tubing hanger 104. As such, none of the main barrier valves 118 for the subsea production system 300 are located in the flowline connection body 108. The flowline connection body 108 is reduced to just a connection interface between the tubing hanger 104/wellhead 102 and the flowline jumper 122.

In the illustrated embodiment, the flowline connection body 108 may include a smaller number of additional valves (or zero valves) than are used in the flowline connection body 108 of FIG. 2. For example, as shown, the flowline connection body 108 may include a PSV 130A and ASV 130B. However, the function of the PSV 130A may similarly be accomplished using a plug set in the flowpath 126A. In still other embodiments, these swab valves 130 may be eliminated entirely from the design of the flowline connection body 108. Additional valves may be included in the tubing hanger 104 and/or the separate flow module 302. For example, in the illustrated embodiment, the XOV 204, PWV 206A, and AWV 206B are each located in the tubing hanger 104, while the PCV 208 and the PSDV 210 are located within the separate flow module 302. With the well kill valves (PCV 208 and PSDV 210) located in the separate flow module 302, the swab valves 130 in the flowline connection body 108 are not required.

If other fluid access points are contained in the subsea production system 300, such as at the flowline connection body 108 or a separate intervention point, heavy well fluids can be injected into the well as a first barrier, and the additional well barrier valves 118 may be closed to create a secondary barrier as needed. All that is needed to provide this function is fluid access to the production system. There is no need for vertical access to the flowline connection body 108 and/or the wellhead 102, since there is no need for installing wireline plugs to create a barrier during well intervention operations.

The disclosed subsea production system 300 may offer various advantages over existing subsea systems that have the main barrier valves located in a subsea tree above the wellhead. By having the well barriers 118 located in the tubing hanger 104, and all the additional valves (130, 204, 206, 208, and 210) distributed between the tubing hanger 104 and the flow module 302, the space taken up by the flowline connection body 108 is greatly reduced, even compared to the embodiment of FIG. 2. This leads to a reduced cost for installation of the flowline connection body 108. The separate flow module 302 allows flexibility for changing and adapting to future well issues. In addition, the illustrated arrangement of valves means that a single compact manifold 202 may be used for connecting the production flowline of the subsea system 300 to a topsides facility. Using the compact header manifold 202 reduces the size, complexity, and weight of the overall subsea production system 300, thereby reducing the time and cost for installation. The compact manifold 202 may be attached to the flow module 302, and the flow module 302 to the flowline connection body 108, via flexible jumpers 304 and 122, respectively, as opposed to larger, more structured jumper assemblies. This provides jumper installation savings. Having the PMV 118A in the tubing hanger 104 facilitates riser light well intervention (RLWI) access. Additionally, having the PMV 118A in the tubing hanger 104 eliminates the need for a full-bore isolation valve (FBIV) to be used during the initial installation of the wellhead assembly and allows for isolation of the main production flowbore during future interventions without setting a temporary plug.

Figure 4:
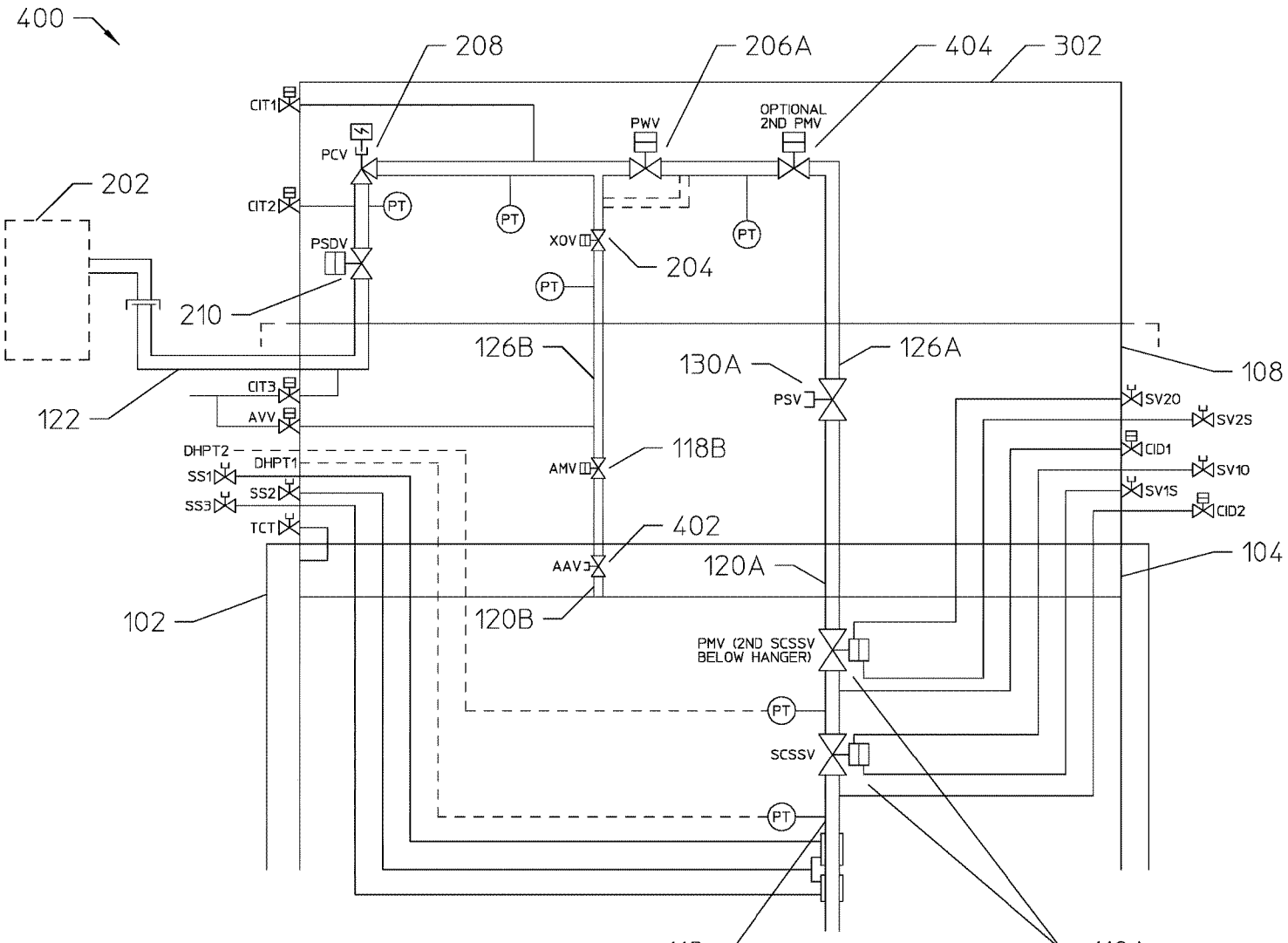
FIG. 4 is a schematic diagram of components of a subsea production system including a flow module located on an upper surface of the flowline connection body, a manifold, and an arrangement of well barriers disposed in the wellhead and/or well completion string, in accordance with an embodiment of the present disclosure.

FIG. 4 is a schematic illustrating an embodiment of a subsea production system 400 with the improved arrangement of well barriers 118, which allows for more simplified controls for the wellhead assembly. The subsea production system 400 enables a streamlined process for retrieving the flowline connection body 108 if needed during production operations. The subsea production system 400 of FIG. 4 is similar to that of FIG. 3, except the features and benefits from the separate flow module 302 of FIG. 3 are incorporated and located directly above the flowline connection body 108. The flow module 302 essentially becomes an upper portion of the flowline connection body 108, as illustrated in FIG. 4. This eliminates the need for two connecting jumpers leading from the flowline connection body 108 to the manifold 202. Only one flowline jumper 122 is used to provide production fluid to the manifold 202.

As illustrated, the flowline connection body 108 connects the production flowpath 120A through the tubing hanger 104 with the above flow module 302, which then communicates production fluid back to the flowline connection body 108. The flowline connection body 108 then communicates this production fluid through a jumper 122 to the subsea production manifold 202. The flow module 302 is located directly above and mounted to an upper portion of the flowline connection body 108, as illustrated.

In the illustrated embodiment, there are no main barrier valves (PMV) located along the production flowpath 120A within the tubing hanger 104. Instead, one PMV 118A is located in the production tubing string 112 just upstream of the tubing hanger 104 (i.e., the second SCSSV 118A below the tubing hanger 104). In this manner, the subsea production system 400 effectively has two main barrier valves 118A in the form of SCSSVs located upstream of the tubing hanger 104. None of the main production barrier valves 118A for the subsea production system 400 are located in the flowline connection body 108. The flowline connection body 108 is reduced to just a connection interface between the tubing hanger 104/wellhead 102 and the flow module 302 above leading to the flowline jumper 122. The main annulus barrier valve 118B (AMV) is located along the annulus flowpath 126B within the flowline connection body 108. The tubing hanger 104 also includes an annulus access valve (AAV) 402 located along the annulus flowpath 120B, and this AAV 402 is an ROV operated valve that acts as a temporary barrier.

In the illustrated embodiment, the flowline connection body 108 may include a smaller number of valves than are used in the flowline connection body 108 of FIG. 2. For example, as shown, the flowline connection body 108 may include a PSV 130A and AMV 118B. The PSV 130A can act as a temporary barrier in the place of a wireline plug or other barrier device if the need arises to remove and/or replace the upper flow module 302. Additional valves may be included in the tubing hanger 104 and/or the upper flow module 302. For example, in the illustrated embodiment, the AAV 402 is located in the tubing hanger 104, while the XOV 204, PWV 206A, PCV 208, and PSDV 210 are located within the upper flow module 302. With the well kill valves (PCV 208 and PSDV 210) located in the flow module 302, an annulus swab valve in the flowline connection body 108 is not required. In some embodiments, an optional additional production main barrier (PMV) 404 may be located within the flow module 302.

The disclosed subsea production system 400 may offer various advantages over existing subsea systems that have the main barrier valves located in a subsea tree above the wellhead. The upper flow module 302, being a separate component from the flowline connection body 108, allows flexibility for changing and adapting to future well issues. For example, if it is desirable to add a choke and a flow meter, those components may be accommodated within the flow module 302. In addition, the illustrated arrangement of valves means that a single compact manifold 202 may be used for connecting the production flowline of the subsea system 400 to a topsides facility. Using the compact header manifold 202 reduces the size, complexity, and weight of the overall subsea production system 400, thereby reducing the time and cost for installation. The compact manifold 202 may be attached to the flowline connection body 108 via a single flexible jumper 122, as opposed to a larger, more structured jumper assembly. This provides jumper installation savings. In the subsea production system 400 of FIG. 4, the valves (204, 206A, 108, 210, and/or 404) within the flow module 302 can be oriented vertically, drastically reducing the size, weight, and cost of the overall wellhead assembly.

Referring to FIGS. 2-4, the disclosed subsea production systems 200, 300, and 400 allow for more efficient actuation means than is currently available using production systems with barriers located in a subsea tree. For example, several valves (130, 204, 206, 208, and 210) may be electrically actuated, since the requirements for closure of such fail-safe valves are not the same as the requirements for closing the well barrier valves 118. The simplified control system is illustrated as various controls positioned along the sides of the flowline connection body 108. This control system may be more distributed to serve components in multiple locations and may be largely electric instead of hydraulic. Such electric operation of valves in the subsea production systems 200 and 300 reduces the hydraulic control fluid consumption in these embodiments. In addition, electric operation of the valves allows for more operating components of the subsea production systems 200 and 300 to be installable and replaceable using a remote operated vehicle (ROV).

The subsea production systems disclosed herein enable standardization of equipment, since the tubing hanger 104 (with the flowline connection body 108) provides essential well barriers 118 that are not project specific. All potential well-specific equipment is instead housed in the downstream flowline jumper equipment (e.g., manifold 202 and/or flow module 302). The subsea production systems disclosed herein allow the downstream project-specific equipment to be configured as needed in a more bolt-together fashion, since the main well barriers 118 are integrated into the wellhead assembly in such a way that a BOP can connect to and control the well in an emergency. More equipment can be retrieved and serviced as a single package, as opposed to building multiple pieces with the capability of them being independently retrievable.

Additional examples of subsea production systems in accordance with the present disclosure are illustrated in FIGS. 5-15. These subsea production systems each have an arrangement of primary well barriers 118A provided in equipment that is located within the well and/or the wellhead housing. That is, each of the primary well barriers 118A may be installed within or below the high pressure wellhead housing 102. Each well barrier 118A may be electrically actuated in some embodiments. In other embodiments, one or more of the well barriers 118A may be hydraulically actuated.

FIGS. 5-15 provide modular arrangements including different components or different combinations of components within a wellhead assembly depending on the needs of the well. The modular arrangement allows customization to meet customer requirements. In each of the disclosed embodiments, the tubing hanger installation and "tree" installation may both be performed while a blowout preventer (BOP) is installed on the wellhead. This provides the ability to drill, complete, and land the "tree" without removing the BOP stack. Thus, the entire drilling and completion process may be completed in one deployment using one (smaller) rig, which reduces the time spent towing and setting up operations per completion. The modular arrangements of components of the wellhead assembly may, in some instances, enable the components to be disassembled one by one while other components remain in the wellhead. This provides added flexibility for performing maintenance or workover operations.

The modular arrangements of components of subsea production systems according to any of FIGS. 1-15 in the present disclosure may be used for one or more of production operations, water injection operations, or carbon ($CO_2$) injection operations. More generally, the subsea production systems disclosed herein may be used for routing fluid through a wellhead assembly. Routing the fluid through the wellhead assembly may include routing fluid from the "tree" (or tree cap) 108 disposed atop a wellhead housing 102 to the tubing string 112 extending downward with respect to the wellhead housing 102 (e.g., injection operations), or vice versa (e.g., production operations).

Figure 5:
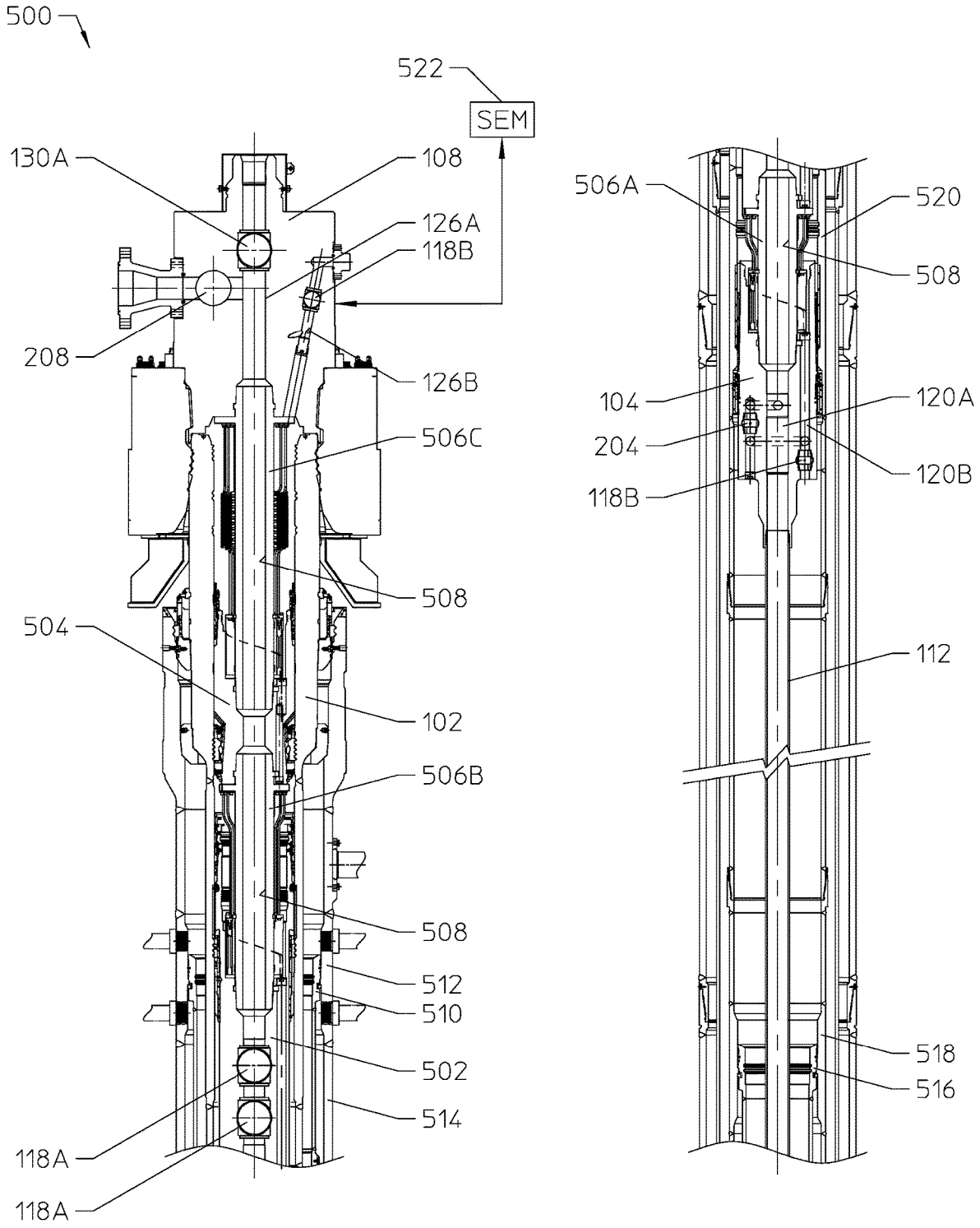
FIG. 5 is a cross sectional view of components of a subsea production system, in accordance with an embodiment of the present disclosure.

FIG. 5 illustrates an example subsea production system 500 that includes an arrangement of well barriers 118 disposed within or below a high pressure wellhead housing 102. The subsea production system 500 of FIG. 5 includes, among other things, the wellhead housing 102, a tubing hanger 104, a valve module 502, a wellhead sensor and injector module 504, the tree cap 108, and three orientation subs 506A, 506B, 506C. As discussed above, the subsea production system 500 includes two main barrier valves 118A, which in the illustrated embodiment are both disposed below the wellhead housing 102. The main barrier valves 118A are a pair of master production valves 118A configured to be selectively actuated from an open position to a closed position to shut in the subsea well.

As shown, the tubing hanger 104 may be positioned below the wellhead housing 102 coupled to a subsea well. The tree cap 108 is fluidly coupled to the tubing hanger 104 and disposed atop the wellhead housing 102. As illustrated, the valve module 502 may be located between the tubing hanger 104 and the wellhead sensor and injector module 504, and the wellhead sensor and injector module 504 may be located between the valve module 502 and the tree cap 108. The first orientation sub 506A may be coupled between the tubing hanger 104 and the valve module 502. The second orientation sub 506B may be coupled between the valve module 502 and the wellhead sensor and injector module 504. The third orientation sub 506C may be coupled between the wellhead sensor and injector module 504 and the tree cap 108.

In FIG. 5, the master production valves 118A are located in and form part of the valve module 502. The valve module 502 may include other features including, for example, actuators for actuating the master production valves 118A. The actuators may be electric or hydraulic actuators configured to selectively open or close the master production valves 118A in response to control signals. As illustrated, the valve module 502 may be separate from and coupled to the tubing hanger 104.

The wellhead sensor and injector module 504 is configured to provide access for sensing and/or chemical injection into the well. The wellhead sensor and injector module 504 is an optional component and may be eliminated from the wellhead assembly in other embodiments. The wellhead sensor and injector module 504 may include one or more sensors, one or more injection flowpaths, or both, to provide access for sensing and/or chemical injection into the well. As illustrated, the wellhead sensor and injector module 504 may be separate from and coupled to the valve module 504. In other embodiments, as described below, the wellhead sensor and injector module features may be incorporated into the valve module.

The tubing hanger 104 may include one or more valves as well. For example, as shown in FIG. 5, the tubing hanger 104 may include a crossover valve (XOV) 204 located between and configured to selectively fluidly connect a production flowpath 120A to an annulus flowpath 120B of the tubing hanger 104. In addition, the tubing hanger 104 may include an annulus valve (e.g., an annulus barrier valve 118B) disposed along the annulus flowpath 120B through the tubing hanger 104. These valves (204 and 118B) may perform the same functions as those described at length above with reference to FIGS. 1-4. As illustrated, the tubing hanger 104 is suspending the tubing string 112 therefrom. Downhole functions may be routed through the bottom of the tubing hanger 104, as shown.

The tree cap 108 may take the form of any of the flowline connector bodies 108 of FIGS. 1-4 described above, or variations thereof. In FIG. 5, the tree cap 108 includes a production swab valve (PSV) 130A, an annulus master valve 118B, and a pressure control valve (PCV) 208. Other combinations and arrangements of valves may be present in the tree cap 108 in other embodiments without departing from the scope of the present disclosure.

Each of the orientation subs 506 may be similar to and/or have a construction similar to that of the tubing hanger alignment device 106 of FIG. 1. In particular, each orientation sub 506 may connect one immediately upper component (e.g., tree cap, wellhead sensor and injector module, valve module) to a corresponding immediately lower component (e.g., wellhead sensor and injector module, valve module, tubing hanger) in the group of components arranged axially within or through the wellhead. Each orientation sub 506 may include a production flowpath 508 extending therethrough for fluidly connecting a production flowpath 120A of the tubing hanger 104 to the production flowpath 126A of the tree cap 108. Each orientation sub 506 may similarly include an annulus flowpath (not shown) extending therethrough for fluidly connecting an annulus flowpath 120B of the tubing hanger 104 to the flowpath 126B of the tree cap 108. One or more of the orientation subs 506 may further include one or more communication lines (e.g., hydraulic fluid lines, electrical lines, and/or fiber optic cables), which are not shown, disposed therethrough and used to communicatively couple the immediately upper component to the immediately lower component.

Like the tubing hanger alignment device 106 described above with reference to FIG. 1, each orientation sub 506 is configured to facilitate a mating connection that communicatively couples the immediately upper component to couplings/stabs on the immediately lower component as the upper component is landed onto or through the wellhead housing 102, regardless of the orientation in which the upper component is initially positioned during the landing process. The orientation sub 506A is configured to be coupled between the valve module 502 and the tubing hanger 104 such that one or more couplers on the valve module 502 can be aligned with one or more couplers on the tubing hanger 104 as the valve module 502 is lowered into or through the wellhead housing 102. Similarly, the orientation sub 506B be coupled between the wellhead sensor and injector module 504 and the valve module 502 such that one or more couplers on the wellhead sensor and injector module 504 can be aligned with one or more couplers on the valve module 502 as the wellhead sensor and injector module 504 is lowered into or through the wellhead housing 102. Similarly, the orientation sub 506C is configured to be coupled between the tree cap 108 and the wellhead sensor and injector module 504 such that one or more couplers on the tree cap 108 can be aligned with one or more couplers on the wellhead sensor and injector module 504 as the tree cap 108 is lowered onto the wellhead housing 102.

The couplers between these various components may be hydraulic, electric, or fiber optic couplers. The alignment between adjacent components of the wellhead assembly available using the orientation subs 506 allows for hydraulic, electric, or fiber optic signals to be communicated up and down the wellhead assembly, from one component to the next, to enable sensing and control of various components located at different levels within the wellhead assembly and/or downhole of the wellhead assembly. This may enable, for example, remote actuation of the annulus valve 118B, the crossover valve 204, the pair of master production valves 118A, various sensors and/or valves in the wellhead sensor and injector module 504, the various valves (e.g., 130A, 130B, 208, etc.) in the tree cap 108, and any subsurface safety valves (not shown) or completion tools that may be incorporated in the tubing string 112.

FIG. 5 illustrates the subsea production system 500 in a fully assembled configuration. As shown, a first casing hanger 510 is hung off in a supplemental adapter 512 in the casing 514 below the wellhead housing 102. A second casing hanger 516 may be hung off in a supplemental adapter 518 below the first casing hanger 510. There may be more or fewer casing hangers hung from supplemental adapters in a nested configuration along the length of the well extending downward from the wellhead assembly. The tubing hanger 104 may be landed in a supplemental adapter 520, e.g., below the wellhead housing 102. In other embodiments, one or more of the tubing hanger 104 and/or casing hangers (e.g., 510) may be landed within and/or hung off the wellhead housing 102. Other relative arrangements of the wellhead housing 102, tubing hanger 104, and various casing hangers and/or adapters may be used in other embodiments without departing from the scope of the present disclosure.

The orientation sub 506A may be attached to a lower portion of the valve module 502. The valve module 502 may then be lowered through the wellhead housing 102 (together with the attached orientation sub 506A) and coupled to the tubing hanger 104 via the orientation sub 506A. The orientation sub 506A may cause the valve module 502 to self-align with the tubing hanger 104 as discussed above. The orientation sub 506B may be attached to a lower portion of the wellhead sensor and injector module 504. The wellhead sensor and injector module 504 may be lowered through the wellhead housing 102 and coupled to the valve module 502 via the orientation sub 506B. The orientation sub 506B may cause the wellhead sensor and injector module 504 to self-align with the valve module 502. The orientation sub 506C may be attached to a lower portion of the tree cap 108. The tree cap 108 may be lowered onto the wellhead housing 102 and coupled to the wellhead sensor and injector module 504 (or alternatively, the valve module 502) via the orientation sub 506C. The orientation sub 506C may cause the tree cap 108 to self-align with the wellhead sensor and injector module 504. The orientation sub(s) 506 allow the tree cap 108 to have a directional orientation independent of the orientation of the tubing hanger 104. The tree cap 108 may be installed by wireline if desired.

It should be noted that the construction of the orientation subs 506 illustrated in FIG. 5 (and elsewhere in this application) may be different in other embodiments. The orientation subs 506 may operate differently than as shown to provide the desired orientation-free connections between subsequent components in the subsea production systems described herein. Various examples of different types of orientation components that may be used as the orientation subs 506 in the present application may be found in U.S. Pat. Nos. 10,830,015; 11,180,968; 11,199,066; and/or U.S. patent application Ser. Nos. 17/050,715; 17/286,214, all of which are owned by Dril-Quip, Inc. and are hereby incorporated by reference into the present disclosure.

All production, annulus, hydraulic, and electrical functions of the wellhead production system 500 may terminate in the tree cap 108 with a subsea electronics module (SEM) 522 coupled to the tree ap 108. The SEM 522 may include a single hydraulic supply line and hydraulic return line for all downhole functions except any surface controlled subsurface safety valves. This reduces the size and complexity of the production umbilical. All downhole chemical injection and sliding sleeves may be accessed through the hydraulic supply line, and flow is controlled within the SEM 522. The hydraulic return line allows hydraulic system flushing without disconnecting the hydraulic functions. The complexity of all of the modules is reduced by the two line hydraulic system when compared to a production system having a line for each downhole function.

As discussed above, the various components (e.g., tubing hanger 104, valve module 502, and/or wellhead sensor and injector module 504) may each be lowered separately through the wellhead housing 102. In other embodiments, however, two or more of these components may be pre-assembled together at the surface and then lowered through the wellhead housing 102 together at the same time.

Figure 6:
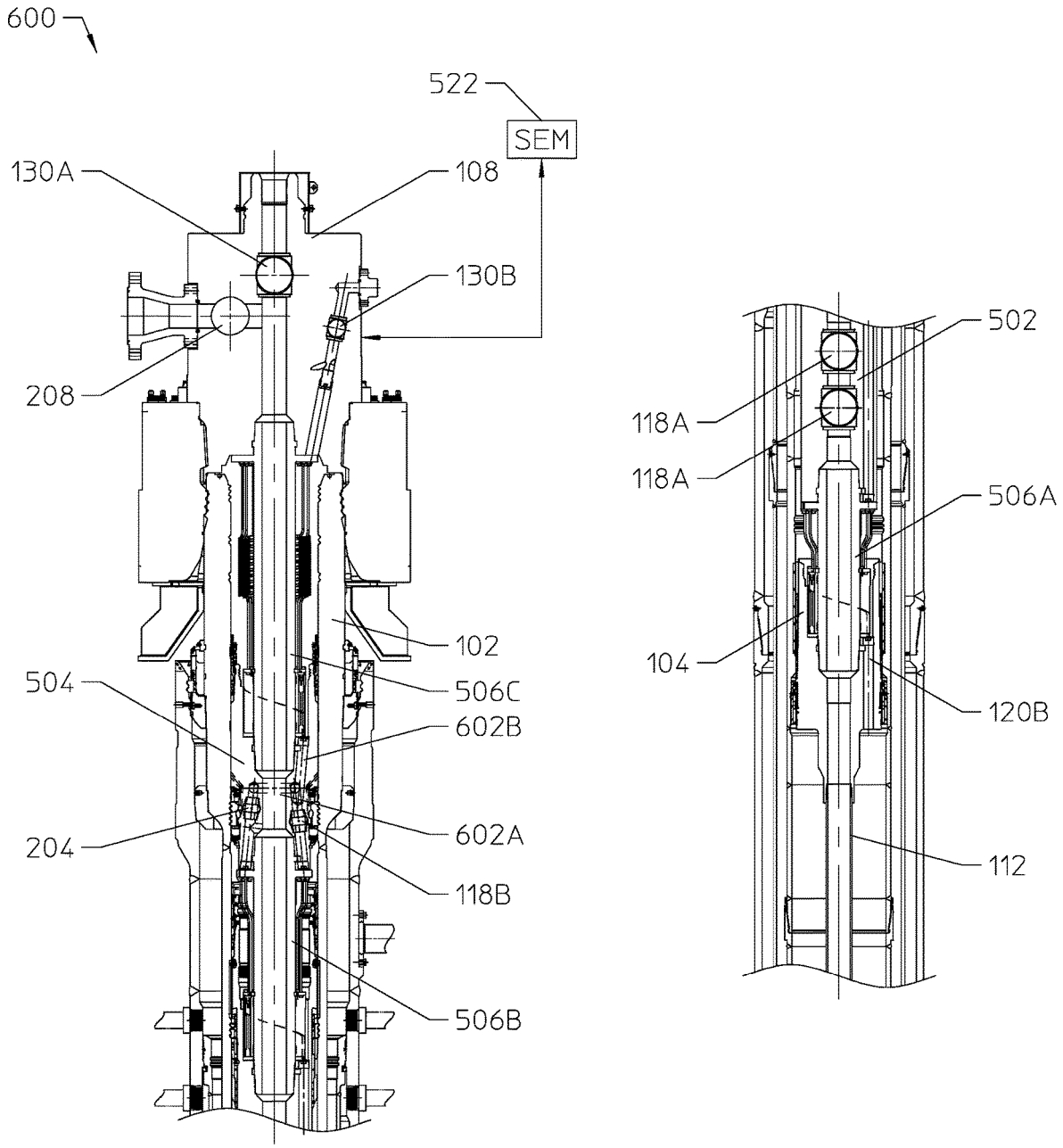
FIG. 6 is a cross sectional view of components of another subsea production system, in accordance with an embodiment of the present disclosure.

FIG. 6 illustrates another example subsea production system 600 that includes an arrangement of well barriers 118 disposed within or below a high pressure wellhead housing 102. The subsea production system 600 of FIG. 6 is similar to the subsea production system 500 of FIG. 5, except that the wellhead sensor and injector module 504 in FIG. 6 has annulus crossover ability, instead of the tubing hanger 104. The subsea production system 600 still includes, among other things, the wellhead housing 102, tubing hanger 104, valve module 502, wellhead sensor and injector module 504, tree cap 108, and orientation subs 506A, 506B, 506C. The pair of master production valves 118A are disposed in the valve module 502 and configured to be selectively actuated from an open position to a closed position to shut in the subsea well. Each of the various modules/components (i.e., 102, 104, 502, 504, 108, and 506) of the subsea production system 600 are arranged with respect to each other along the length of the wellhead assembly as discussed at length above with reference to FIG. The wellhead housing 102, valve module 502, tree cap 108, and orientation subs 506 may have substantially the same structure as those of FIG. 5, with the exception of any differing control lines extending therethrough due to the location of the crossover and annulus valves closer to the top of the assembly. As with FIG. 5, all production, annulus, hydraulic, and electrical functions of the wellhead production system 600 of FIG. 6 may terminate in the tree cap 108 with the SEM 522. The subsea production system 600 of FIG. 6 may be installed via a similar method as described above with reference to FIG. 5.

The wellhead sensor and injector module 504 is configured to provide access for sensing and/or chemical injection into the well. The wellhead sensor and injector module 504 may include one or more sensors, one or more injection flowpaths, or both, to provide access for sensing and/or chemical injection into the well. In addition to these features, the wellhead sensor and injector module 504 may include one or more valves disposed therein. For example, as shown in FIG. 6, the wellhead sensor and injector module 504 may include a XOV 204 located between and configured to selectively fluidly connect a production flowpath 602A to an annulus flowpath 602B of the wellhead sensor and injector module 504. In addition, the wellhead sensor and injector module 504 may include an annulus valve (e.g., an annulus barrier valve 118B) disposed along the annulus flowpath 602B through the wellhead sensor and injector module 504. These valves (204 and 118B) may perform the same functions as those described at length above with reference to FIGS. 1-4. As shown in FIG. 6, the tubing hanger 104 may not include any such valves in some embodiments. For example, as illustrated, the tubing hanger 104 may simply suspend the tubing string 112 therefrom and, if needed, receive a plug lowered into its production flowpath 120A. In other embodiments, the tubing hanger 104 may further include another annulus valve 118B along the annulus flowpath 120B therethrough. Downhole functions may be routed through the bottom of the tubing hanger 104.

The configuration of the subsea production system 600 of FIG. 6 having the XOV 204 and annulus valve 118B located in the wellhead sensor and injector module 504 allows for a more easy retrieval and replacement of components that are more likely to fail within the subsea production system 600. For example, the XOV 204 and annulus valve 118B may be more likely to fail or require replacement over the life of the well. If workover operations are needed to repair or replace the XOV 204 and/or the annulus valve 118B, then only the tree cap 108 and its associated orientation sub 506C would need to be removed from the wellhead housing 102 to provide access to the wellhead sensor and injector module 504 with the valves 204/118B. The tubing string 112 would not have to be pulled during such workover operations. This may reduce a total rig workover time.

In embodiments where the XOV 204 and annulus valve 118B are located in the wellhead sensor and injector module 504, the valve module 502 may also include an annulus valve (not shown) disposed therein as well, to allow for closing off annulus flow should the wellhead sensor and injector module 504 be removed.

Figure 7:
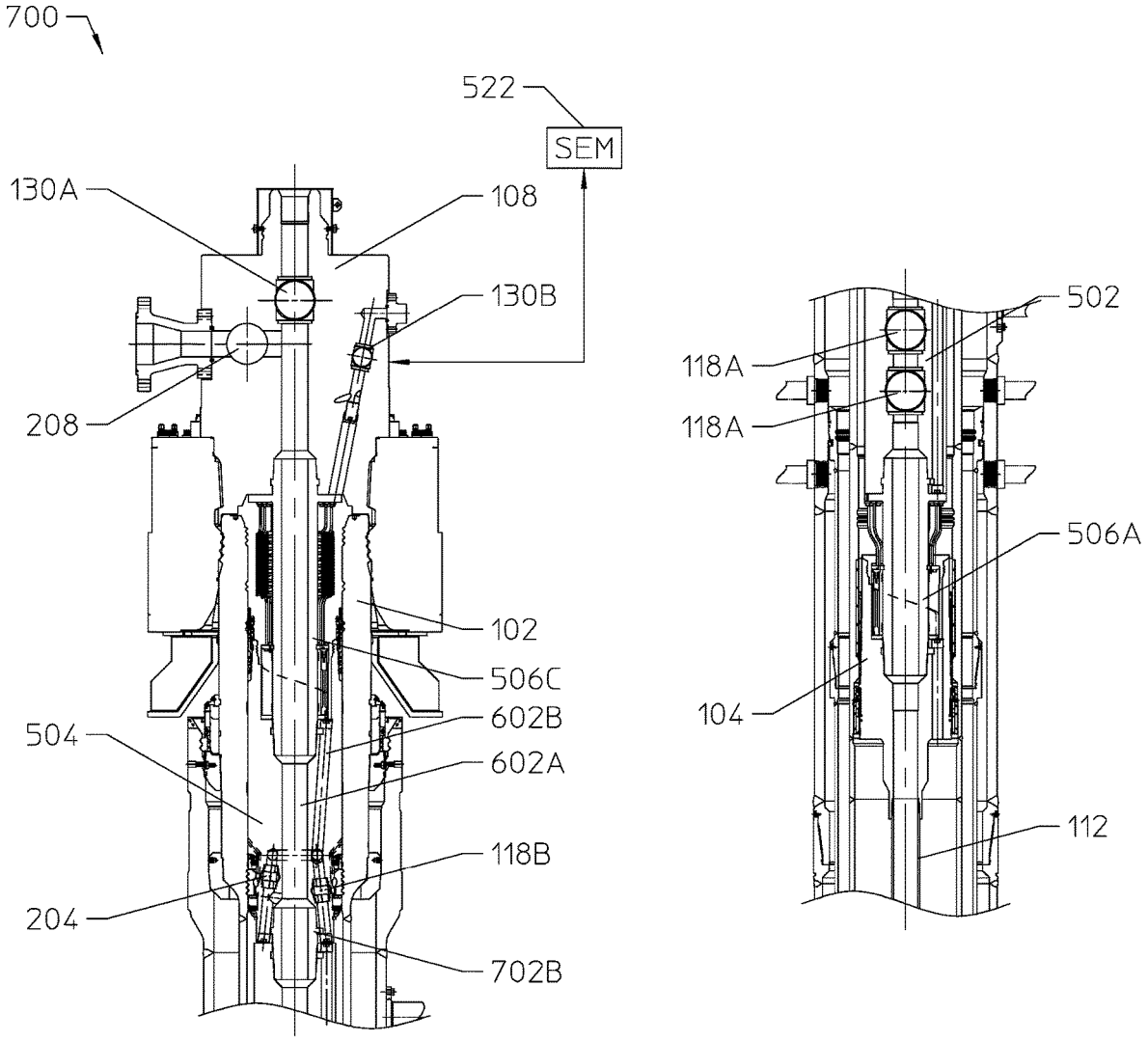
FIG. 7 is a cross sectional view of components of another subsea production system, in accordance with an embodiment of the present disclosure.

FIG. 7 illustrates another example subsea production system 700 that includes an arrangement of well barriers 118 disposed within or below a high pressure wellhead housing 102. The subsea production system 700 of FIG. 7 is similar to the subsea production system 600 of FIG. 6, except that the wellhead sensor and injector module 504 is fastened to the valve module 502 in FIG. 7, instead of coupled via an orientation sub. The subsea production system 700 still includes, among other things, the wellhead housing 102, tubing hanger 104, valve module 502, wellhead sensor and injector module 504, tree cap 108, and two orientation subs 506A and 506C. The pair of master production valves 118A are disposed in the valve module 502 and configured to be selectively actuated from an open position to a closed position to shut in the subsea well. Each of the various modules/components (i.e., 102, 104, 502, 504, 108, 506A, and 506C) of the subsea production system 700 are arranged with respect to each other along the length of the wellhead assembly as discussed at length above with reference to FIG. 5. The wellhead housing 102, tubing hanger 104, valve module 502, wellhead sensor and injector module 504, tree cap 108, and orientation subs 506A and 506C may have substantially the same structure and variations as those described above with reference to FIG. 6. As with FIG. 5, all production, annulus, hydraulic, and electrical functions of the wellhead production system 700 of FIG. 7 may terminate in the tree cap 108 with the SEM 522.

As illustrated in FIG. 7, the wellhead sensor and injector module 504 may be attached to the valve module 502 via an attachment sub 702B. Additionally, or alternatively, the wellhead sensor and injector module 504 may be bolted directly to the valve module 502. The attachment sub 702B may be any desired type of coupling mechanism that fixes the wellhead sensor and injector module 504 to the valve module 502, substantially preventing or restricting relative rotation or translation between the two components. The attachment sub 702B may have one or more flowpaths, electric lines, and/or fiber optic cables extending therethrough to communicatively couple one or more lines of the wellhead sensor and injector module 504 to one or more corresponding lines of the valve module 502. The wellhead sensor and injector module 504 may be attached to the valve module 502 via the attachment sub 702B at a surface location, and then the components may be lowered through the wellhead housing 102 together at the same time (e.g., along with the orientation sub 506A). Having the wellhead sensor and injector module 504 attached to the valve module 502 may simplify the process of running the subsea production system 700 compared to other assemblies described herein.

Figure 8:
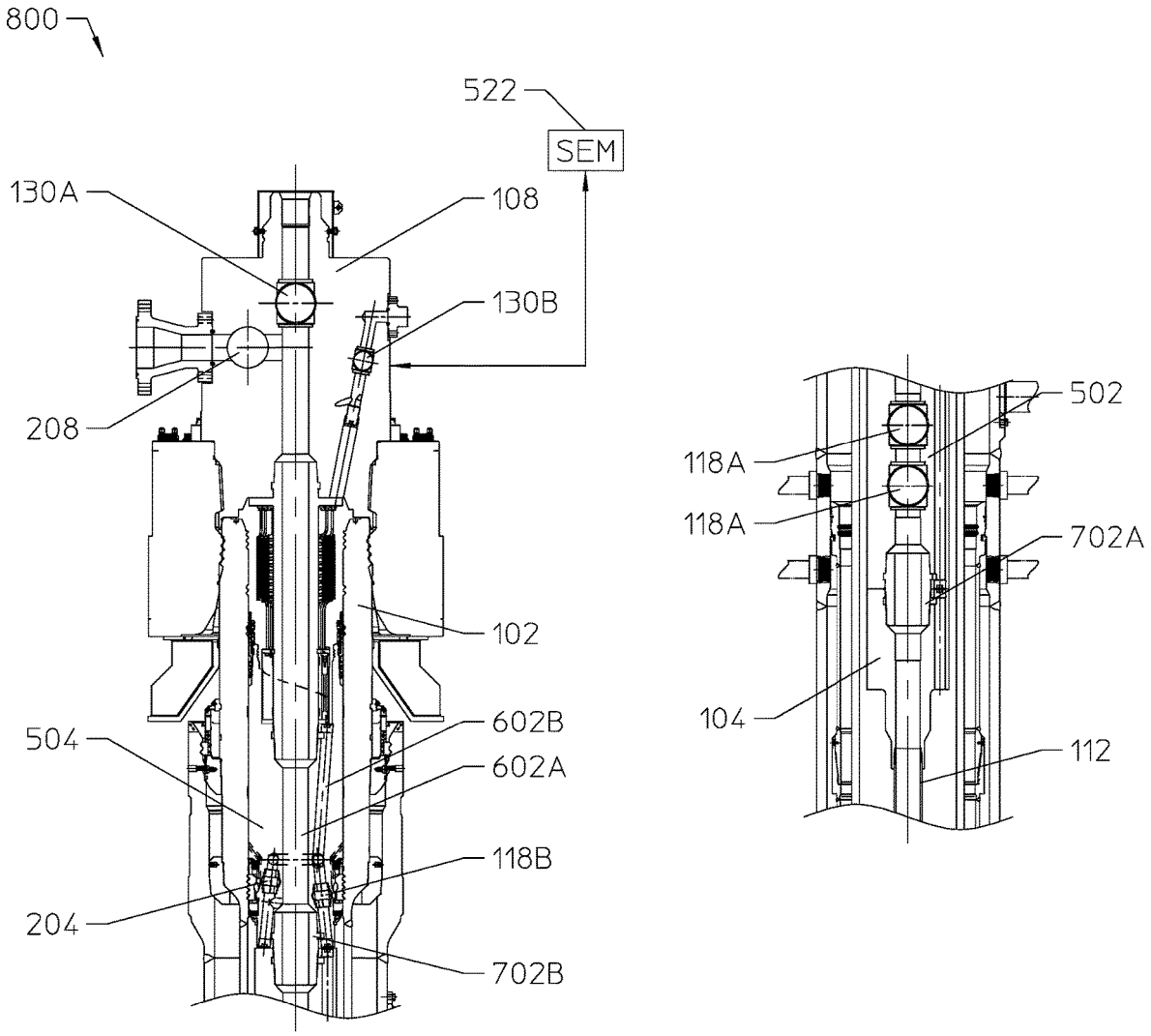
FIG. 8 is a cross sectional view of components of another subsea production system, in accordance with an embodiment of the present disclosure.

FIG. 8 illustrates another example subsea production system 800 that includes an arrangement of well barriers 118 disposed within or below a high pressure wellhead housing 102. The subsea production system 800 of FIG. 8 is similar to the subsea production system 700 of FIG. 7, except that the valve module 502 is fastened to the tubing hanger 104 in FIG. 8, instead of coupled via an orientation sub. The subsea production system 800 still includes, among other things, the wellhead housing 102, tubing hanger 104, valve module 502, wellhead sensor and injector module 504, tree cap 108, attachment sub 702B, and one orientation sub 506C. The pair of master production valves 118A are disposed in the valve module 502 and configured to be selectively actuated from an open position to a closed position to shut in the subsea well. Each of the various modules/components (i.e., 102, 104, 502, 504, 108, and 506C) of the subsea production system 800 are arranged with respect to each other along the length of the wellhead assembly as discussed at length above with reference to FIG. 5. The wellhead housing 102, tubing hanger 104, valve module 502, wellhead sensor and injector module 504, tree cap 108, and orientation sub 506C may have substantially the same structure and variations as those described above with reference to FIG. 6. In addition, the attachment sub 702B may have substantially the same structure and arrangement with respect to other components of the subsea production system 800 as the attachment sub 702B introduced in FIG. 7. As with FIG. 5, all production, annulus, hydraulic, and electrical functions of the wellhead production system 800 of FIG. 8 may terminate in the tree cap 108 with the SEM 522.

As illustrated in FIG. 8, the valve module 502 may be attached to the tubing hanger 104 via an attachment sub 702A. Additionally, or alternatively, the valve module 502 may be bolted directly to the tubing hanger 104. The attachment sub 702A may be substantially similar in structure and functionality to the attachment sub 702B described above with reference to FIG. 7. The tubing hanger 104, valve module 502, and wellhead sensor and injector module 504 may all be attached via the attachment subs 702A and 702B at a surface location, and then the components may be lowered through the wellhead housing 102 together at the same time. Once landed, the wellhead sensor and injector module 504 may be coupled to the inner bore of the wellhead housing 102 so that the valve module 502 and tubing hanger 104 hang therefrom. Having the wellhead sensor and injector module 504 attached to the valve module 502 and the valve module 502 attached to the tubing hanger 104 may simplify the process of running the subsea production system 800 compared to other assemblies described herein, as everything but the tree cap 108 may be assembled and installed as one unit.

Figure 9:
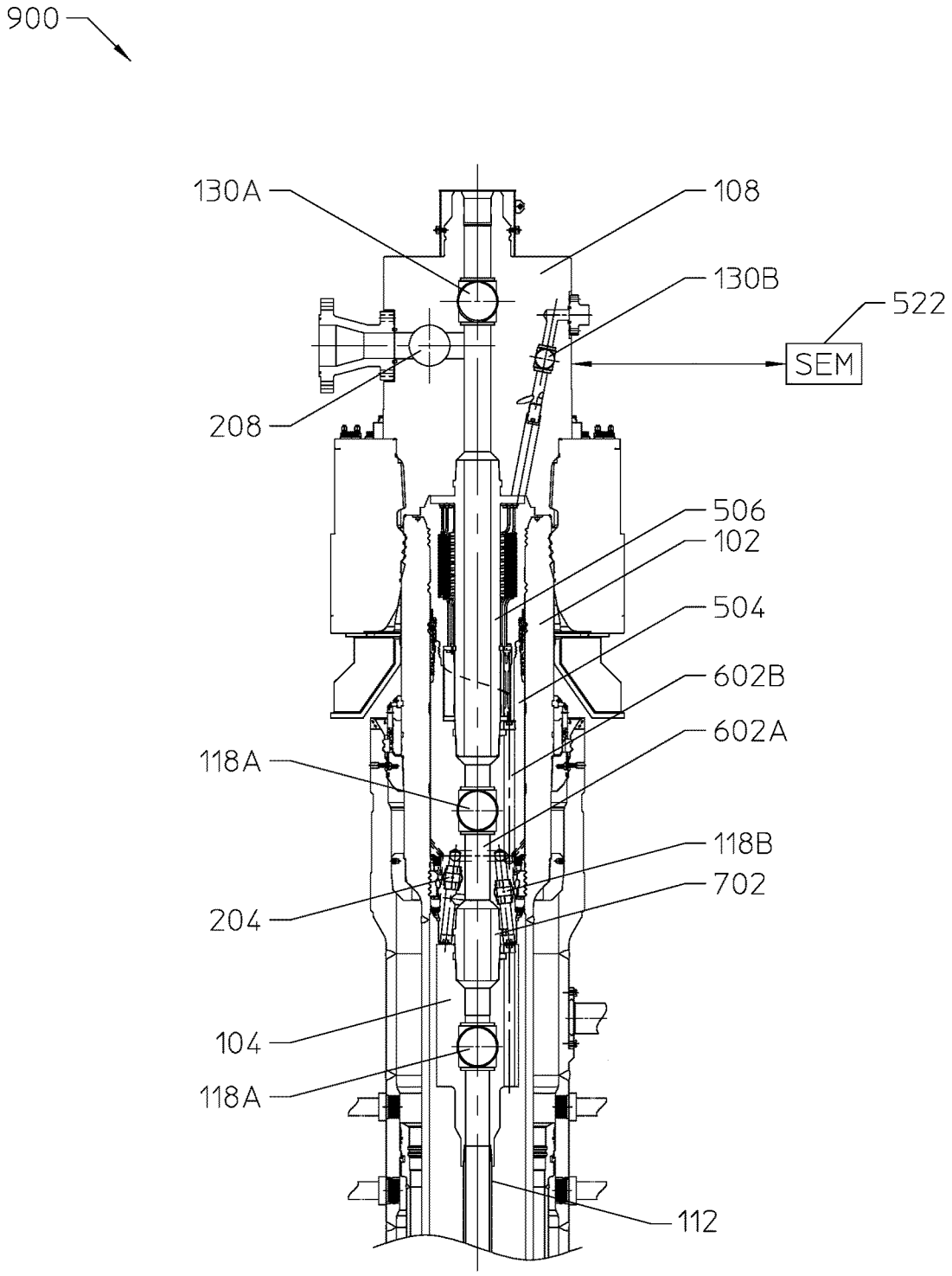
FIG. 9 is a cross sectional view of components of another subsea production system, in accordance with an embodiment of the present disclosure.

FIG. 9 illustrates another example subsea production system 900 that includes an arrangement of well barriers 118 disposed within or below a high pressure wellhead housing 102. The subsea production system 900 of FIG. 9 includes, among other things, the wellhead housing 102, a tubing hanger 104, a wellhead sensor and injector module 504, the tree cap 108, an orientation sub 506, and an attachment sub 702. As discussed above, the subsea production system 900 includes two main barrier valves 118A, which in the illustrated embodiment are disposed one within and one below the wellhead housing 102. The main barrier valves 118A are a pair of master production valves 118A configured to be selectively actuated from an open position to a closed position to shut in the subsea well.

As shown, the tubing hanger 104 may be positioned below the wellhead housing 102 coupled to a subsea well. The tree cap 108 is fluidly coupled to the tubing hanger 104 and disposed atop the wellhead housing 102. As illustrated, the wellhead sensor and injector module 504 may be located between the tubing hanger 104 and the tree cap 108. The orientation sub 506 may be coupled between the wellhead sensor and injector module 504 and the tree cap 108. The orientation sub 506 may have substantially the same structure and variations as, for example, the orientation sub 506C described above with reference to FIG. 5.

The wellhead sensor and injector module 504 may be fastened to the tubing hanger 104. For example, the wellhead sensor and injector module 504 may be attached to the tubing hanger 104 via an attachment sub 702. Additionally, or alternatively, the wellhead sensor and injector module 504 may be bolted directly to the tubing hanger 104. The attachment sub 702 may be substantially similar in structure and functionality to the attachment sub 702B described above with reference to FIG. 7.

In FIG. 9, a first (upper) master production valve 118A is located in and forms part of the wellhead sensor and injector module 504. The wellhead sensor and injector module 504 may include other features including, for example, an actuator for actuating the first master production valve 118A. The actuator may be an electric or hydraulic actuator configured to selectively open or close the master production valve 118A in response to control signals. In FIG. 9, a second (lower) master production valve 118A is located in the tubing hanger 104. The tubing hanger 104 may include other features including, for example, an actuator for actuating the second master production valve 118A. The actuator may be an electric or hydraulic actuator configured to selectively open or close the master production valve 118A in response to control signals.

The wellhead sensor and injector module 504 is also configured to provide access for sensing and/or chemical injection into the well. The wellhead sensor and injector module 504 may include one or more sensors, one or more injection flowpaths, or both, to provide access for sensing and/or chemical injection into the well. The wellhead sensor and injector module 504 may include one or more other valves as well. For example, as shown in FIG. 9, the wellhead sensor and injector module 504 may include a crossover valve (XOV) 204 located between and configured to selectively fluidly connect a production flowpath 602A to an annulus flowpath 602B of the wellhead sensor and injector module 504. In addition, the wellhead sensor and injector module 504 may include an annulus valve (e.g., an annulus barrier valve 118B) disposed along the annulus flowpath 602B through the wellhead sensor and injector module 504. These valves (204 and 118B) may perform the same functions as those described at length above with reference to FIGS. 1-4.

As illustrated, the tubing hanger 104 is suspending the tubing string 112 therefrom. Downhole functions may be routed through the bottom of the tubing hanger 104, as shown.

The tree cap 108 may be substantially similar in structure and functionality to the tree cap 108 described above with reference to FIG. 5. As with FIG. 5, all production, annulus, hydraulic, and electrical functions of the wellhead production system 800 of FIG. 8 may terminate in the tree cap 108 with the SEM 522.

FIG. 9 illustrates the subsea production system 900 in a fully assembled configuration. The arrangement of casing hangers, adapters, and the wellhead housing are substantially similar to those described with reference to FIG. 5. However, other relative arrangements of the wellhead housing 102 and various casing hangers and/or adapters may be used in other embodiments without departing from the scope of the present disclosure.

The tubing hanger 104 and wellhead sensor and injector module 504 may be attached via the attachment sub 702 at a surface location, and then the components may be lowered through the wellhead housing 102 together at the same time. The wellhead sensor and injector module 504 may be coupled to the inner bore of the wellhead housing 102 so that the tubing hanger 104 hangs therefrom. Having the wellhead sensor and injector module 504 attached to the tubing hanger 104 may simplify the process of running the subsea production system 900 compared to other assemblies described herein, as everything but the tree cap 108 may be assembled and installed as one unit. The orientation sub 506 may be attached to a lower portion of the tree cap 108. The tree cap 108 may be lowered onto the wellhead housing 102 and coupled to the wellhead sensor and injector module 504 via the orientation sub 506. The orientation sub 506 may cause the tree cap 108 to self-align with the wellhead sensor and injector module 504. The orientation sub 506 allows the tree cap 108 to have a directional orientation independent of the orientation of the tubing hanger 104. The tree cap 108 may be installed by wireline if desired.

Including only the wellhead sensor and injector module 504 and tubing hanger 104, (without a separate valve module), as in FIG. 9, may lead to cost reductions compared to other embodiments disclosed herein. The subsea production system 900 of FIG. 9 may be particularly suitable for use in carbon capture operations.

Figure 10:
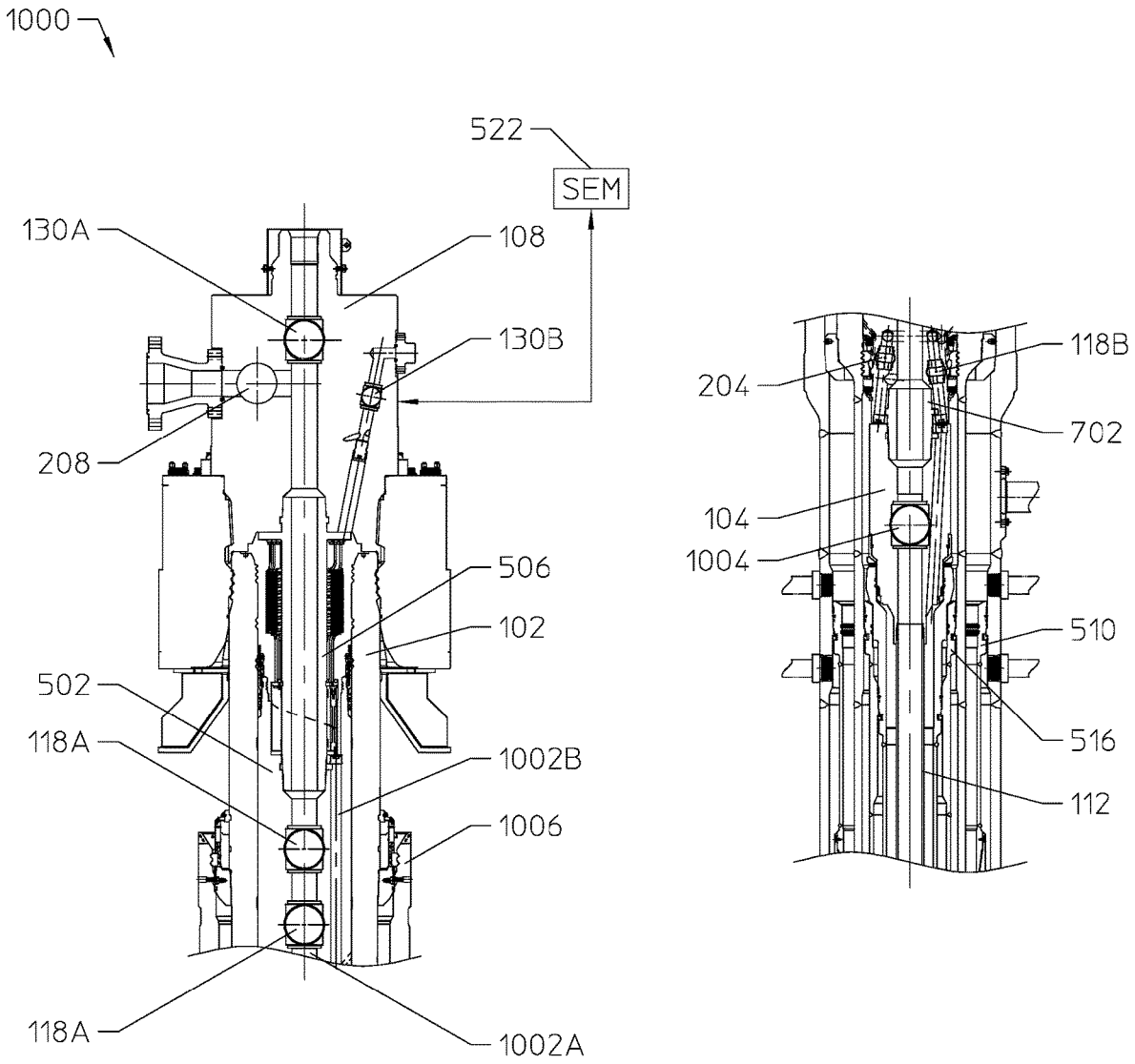
FIG. 10 is a cross sectional view of components of another subsea production system, in accordance with an embodiment of the present disclosure.

FIG. 10 illustrates another example subsea production system 1000 that includes an arrangement of well barriers 118 disposed within or below a high pressure wellhead housing 102. The subsea production system 1000 of FIG. 10 includes, among other things, the wellhead housing 102, a tubing hanger 104, a valve module 502, the tree cap 108, an orientation sub 506, and an attachment sub 702. As discussed above, the subsea production system 1000 includes two main barrier valves 118A, which in the illustrated embodiment are disposed within the wellhead housing 102. The main barrier valves 118A are a pair of master production valves 118A configured to be selectively actuated from an open position to a closed position to shut in the subsea well.

As shown, the tubing hanger 104 may be positioned below the wellhead housing 102 coupled to a subsea well. The tree cap 108 is fluidly coupled to the tubing hanger 104 and disposed atop the wellhead housing 102. As illustrated, the valve module 502 may be located between the tubing hanger 104 and the tree cap 108. The orientation sub 506 may be coupled between the valve module 502 and the tree cap 108. The valve module 502 may be fastened to the tubing hanger 104, e.g., via the attachment sub 702 and/or bolted directly to the tubing hanger 104.

In FIG. 10, the master production valves 118A are located in and form part of the valve module 502. The valve module 502 may include other features including, for example, actuators for actuating the master production valves 118A. The actuators may be electric or hydraulic actuators configured to selectively open or close the master production valves 118A in response to control signals. As illustrated, the valve module 502 may be separate from and coupled to the tubing hanger 104.

In addition to housing the master production valves 118A, the valve module 502 may be configured to provide access for sensing and/or chemical injection into the well. The valve module 502 may include one or more sensors, one or more injection flowpaths, or both, to provide access for sensing and/or chemical injection into the well. As such, features and functions of the wellhead sensor and injector module (e.g., 504) of FIG. 5 may be incorporated into the valve module 502. The valve module 502 may include one or more other valves as well. For example, as shown in FIG. 10, the valve module 502 may include a XOV 204 located between and configured to selectively fluidly connect a production flowpath 1002A to an annulus flowpath 1002B of the valve module 502. In addition, the valve module 502 may include an annulus valve (e.g., an annulus barrier valve 118B) disposed along the annulus flowpath 1002B through the valve module 502. These valves (204 and 118B) may perform the same functions as those described at length above with reference to FIGS. 1-4.

As illustrated, the tubing hanger 104 is suspending the tubing string 112 therefrom. Downhole functions may be routed through the bottom of the tubing hanger 104, as shown. As shown in FIG. 10, the tubing hanger 104 may include a production isolation valve 1004. The production isolation valve 1004 may provide the function of a crown plug without requiring a trip to install such a plug.

The tree cap 108 may be substantially similar in structure and functionality to the tree cap 108 described above with reference to FIG. 5. As with FIG. 5, all production, annulus, hydraulic, and electrical functions of the wellhead production system 800 of FIG. 8 may terminate in the tree cap 108 with the SEM 522.

FIG. 10 illustrates the subsea production system 1000 in a fully assembled configuration. As shown, a first casing hanger 510 and second casing hanger 516 may each be landed in the wellhead as defined by a low pressure wellhead housing 1006. There may be more or fewer casing hangers hung from the wellhead or from supplemental adapters in a nested configuration along the length of the well extending downward from the wellhead assembly. The tubing hanger 104 may be landed on the casing hanger 516, e.g., below the wellhead housing 102 in FIG. 10. Other relative arrangements of the wellhead housing 102, tubing hanger 104, and various casing hangers and/or adapters may be used without departing from the scope of the present disclosure.

The tubing hanger 104 and valve module 502 may be attached via the attachment sub 702 at a surface location, and then the components may be lowered through the wellhead housing 102 together at the same time. Having the valve module 502 attached to the tubing hanger 104 may simplify the process of running the subsea production system 1000 compared to other assemblies described herein, as everything but the tree cap 108 may be assembled and installed as one unit. The orientation sub 506 may be attached to a lower portion of the tree cap 108. The tree cap 108 may be lowered onto the wellhead housing 102 and coupled to the valve module 502 via the orientation sub 506. The orientation sub 506 may cause the tree cap 108 to self-align with the valve module 502. The orientation sub 506 allows the tree cap 108 to have a directional orientation independent of the orientation of the tubing hanger 104. The tree cap 108 may be installed by wireline if desired.

Figure 11:
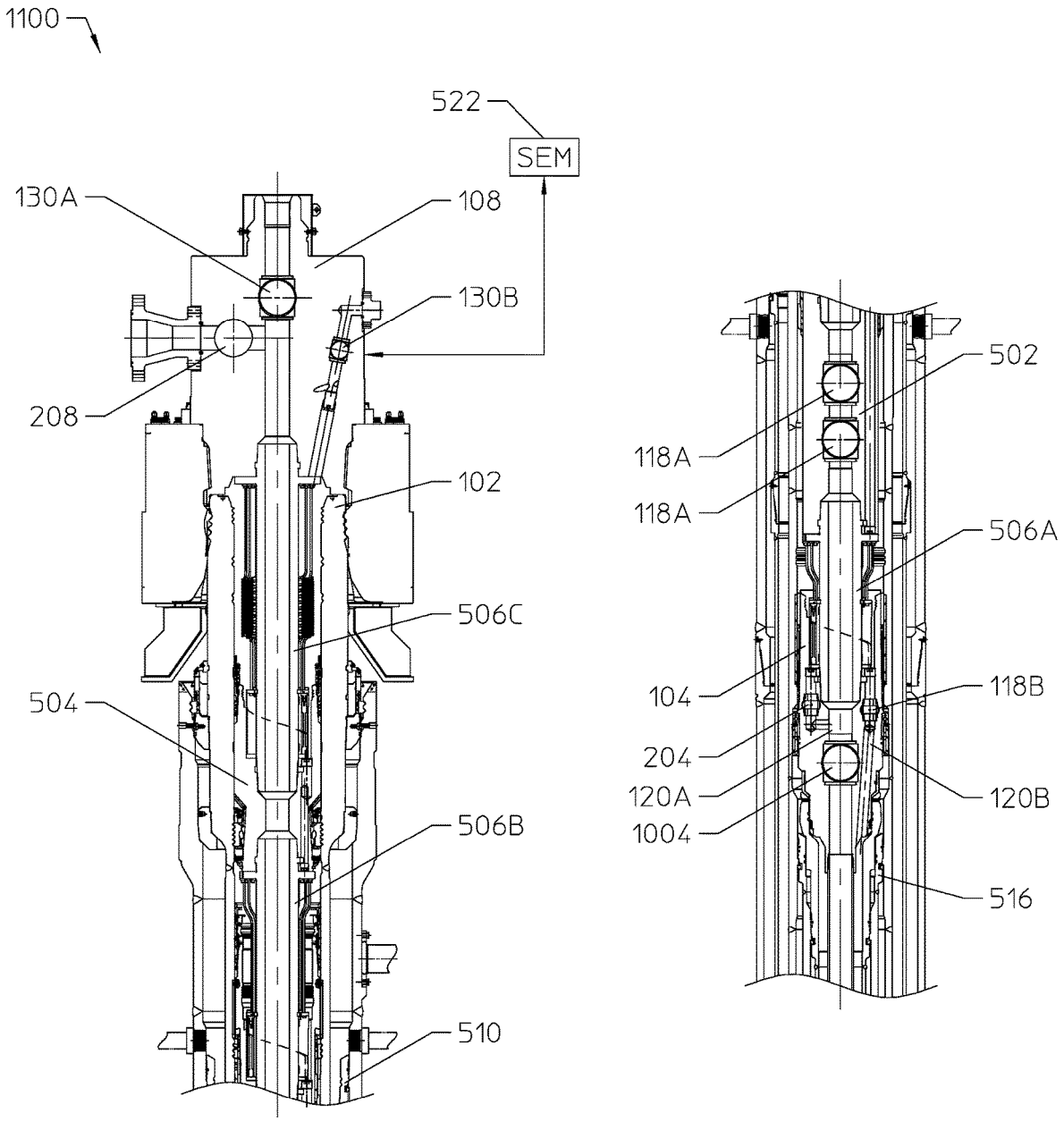
FIG. 11 is a cross sectional view of components of another subsea production system, in accordance with an embodiment of the present disclosure.

FIG. 11 illustrates another example subsea production system 1100 that includes an arrangement of well barriers 118 disposed within or below a high pressure wellhead housing 102. The subsea production system 1100 of FIG. 11 is similar to the subsea production system 500 of FIG. 5, except that the tubing hanger 104 in FIG. 11 has a production isolation valve 1004 therein, and the tubing hanger 104 is landed on the casing hanger 516, e.g., below the wellhead housing 102. The subsea production system 1100 still includes, among other things, the wellhead housing 102, valve module 502, wellhead sensor and injector module 504, tree cap 108, and orientation subs 506A, 506B, 506C described above with reference to FIG. 5. The pair of master production valves 118A are disposed in the valve module 502 and configured to be selectively actuated from an open position to a closed position to shut in the subsea well. Each of the various modules/components (i.e., 102, 502, 504, 108, and 506) of the subsea production system 1100 are arranged with respect to each other along the length of the wellhead assembly as discussed at length above with reference to FIG. 5. The wellhead housing 102, valve module 502, wellhead sensor and injector module 504, tree cap 108, and orientation subs 506 may have substantially the same structure as those of FIG. 5. As with FIG. 5, all production, annulus, hydraulic, and electrical functions of the wellhead production system 1100 of FIG. 11 may terminate in the tree cap 108 with the SEM 522. The subsea production system 1100 of FIG. 11 may be installed via a similar method as described above with reference to FIG. 5, except with the tubing hanger 104 landed on the casing hanger 516 as in FIG. 10.

The configuration of the tubing hanger 104 having the production isolation valve 1004 disposed therein allows for the removal of components located above the tubing hanger 104 without having to set a plug in the subsea production system 1100. Simply actuating the production isolation valve 1004 and the annulus valve 118B closed from the surface (e.g., via electric or hydraulic signaling) provides isolation of the well, such that the components above the tubing hanger 104 may be removed without a riser. The above components may then be removed one at a time via wireline or remote operated vehicle (ROV), using a smaller vessel than would otherwise be needed if the production flowline were not isolated in this manner. As such, the production isolation valve 1004 may provide the function of a crown plug without requiring a trip to install such a plug.

Figure 12:
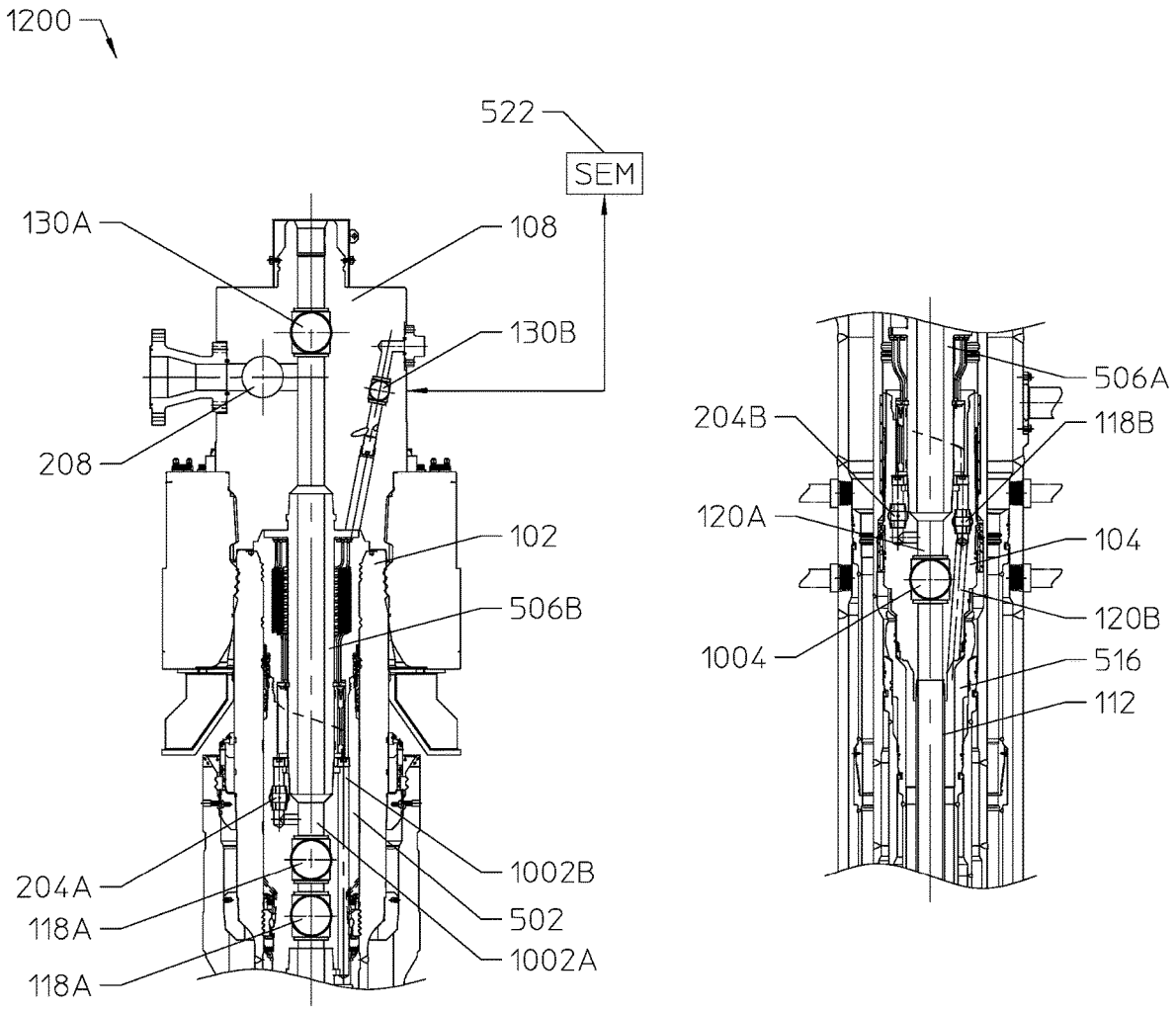
FIG. 12 is a cross sectional view of components of another subsea production system, in accordance with an embodiment of the present disclosure.

FIG. 12 illustrates another example subsea production system 1200 that includes an arrangement of well barriers 118 disposed within or below a high pressure wellhead housing 102. The subsea production system 1200 of FIG. 12 includes, among other things, the wellhead housing 102, a tubing hanger 104, a valve module 502, the tree cap 108, and two orientation subs 506A and 506B. As discussed above, the subsea production system 1200 includes two main barrier valves 118A, which in the illustrated embodiment are disposed within the wellhead housing 102. The main barrier valves 118A are a pair of master production valves 118A configured to be selectively actuated from an open position to a closed position to shut in the subsea well.

As shown, the tubing hanger 104 may be positioned below the wellhead housing 102 coupled to a subsea well. The tree cap 108 is fluidly coupled to the tubing hanger 104 and disposed atop the wellhead housing 102. As illustrated, the valve module 502 may be located between the tubing hanger 104 and the tree cap 108. The orientation sub 506A may be coupled between the tubing hanger 104 and the valve module 502, and the orientation sub 506B may be coupled between the valve module 502 and the tree cap 108.

In FIG. 12, the master production valves 118A are located in and form part of the valve module 502. The valve module 502 may include other features including, for example, actuators for actuating the master production valves 118A. The actuators may be electric or hydraulic actuators configured to selectively open or close the master production valves 118A in response to control signals. As illustrated, the valve module 502 may be separate from and coupled to the tubing hanger 104.

In addition to housing the master production valves 118A, the valve module 502 may be configured to provide access for sensing and/or chemical injection into the well. The valve module 502 may include one or more sensors, one or more injection flowpaths, or both, to provide access for sensing and/or chemical injection into the well. As such, features and functions of the wellhead sensor and injector module (e.g., 504) of FIG. 5 may be incorporated into the valve module 502. The valve module 502 may include one or more other valves as well. For example, as shown in FIG. 12, the valve module 502 may include a first XOV 204A located between and configured to selectively fluidly connect a production flowpath 1002A to an annulus flowpath 1002B of the valve module 502. In addition, although not shown, the valve module 502 may include an annulus valve (e.g., an annulus barrier valve 118B) disposed along the annulus flowpath 1002B through the valve module 502. These valves (204A and 118B) may perform the same functions as those described at length above with reference to FIGS. 1-4.

As illustrated, the tubing hanger 104 is suspending the tubing string 112 therefrom. Downhole functions may be routed through the bottom of the tubing hanger 104, as shown. The tubing hanger 104 may have a similar structure and function as the tubing hanger 104 in FIG. 11. For example, the tubing hanger 104 may include a second XOV 204B located between and configured to selectively fluidly connect a production flowpath 120A to an annulus flowpath 120B of the tubing hanger 104. In addition, the tubing hanger 104 may include an valve 118B disposed along the annulus flowpath 120B through the tubing hanger 104. These valves (204B and 118B) may perform the same functions as those described at length above with reference to FIGS. 1-4. In addition, as shown in FIG. 12, the tubing hanger 104 may include a production isolation valve 1004. The production isolation valve 1004 may provide the function of a crown plug without requiring a trip to install such a plug.

Having two sets of crossover valving provides more ways to crossover the annulus in the subsea production system 1200 of FIG. 12. This may provide increased flexibility for the use of the subsea production system 1200 and enable the use of the subsea production system 1200 for gas lift operations, among other operations.

The tree cap 108 may be substantially similar in structure and functionality to the tree cap 108 described above with reference to FIG. 5. As with FIG. 5, all production, annulus, hydraulic, and electrical functions of the wellhead production system 800 of FIG. 8 may terminate in the tree cap 108 with the SEM 522. The tree cap 108 may contain a hydraulic supply line valve and hydraulic return line valve. The hydraulic return line allows hydraulic system flushing without disconnecting hydraulic functions. The complexity of all the modules is reduced by the two line hydraulic system when compared to a line for each downhole function.

FIG. 12 illustrates the subsea production system 1200 in a fully assembled configuration. As shown, a first casing hanger 510 and second casing hanger 516 may each be landed in the wellhead as defined by the low pressure wellhead housing 1006. There may be more or fewer casing hangers hung from the wellhead or from supplemental adapters in a nested configuration along the length of the well extending downward from the wellhead assembly. The tubing hanger 104 may be landed on the casing hanger 516, e.g., below the wellhead housing 102 in FIG. 12. Other relative arrangements of the wellhead housing 102, tubing hanger 104, and various casing hangers and/or adapters may be used without departing from the scope of the present disclosure.

The orientation sub 506A may be attached to a lower portion of the valve module 502. The valve module 502 may be lowered through the wellhead housing 102 and coupled to the tubing hanger 104 via the orientation sub 506A. The orientation sub 506A may cause the valve module 502 to self-align with the tubing hanger 104. The orientation sub 506B may be attached to a lower portion of the tree cap 108. The tree cap 108 may be lowered onto the wellhead housing 102 and coupled to the valve module 502 via the orientation sub 506B. The orientation sub 506B may cause the tree cap 108 to self-align with the valve module 502. The orientation subs 506A and 506B allow the tree cap 108 to have a directional orientation independent of the orientation of the tubing hanger 104. The tree cap 108 may be installed by wireline if desired.

Figure 13:
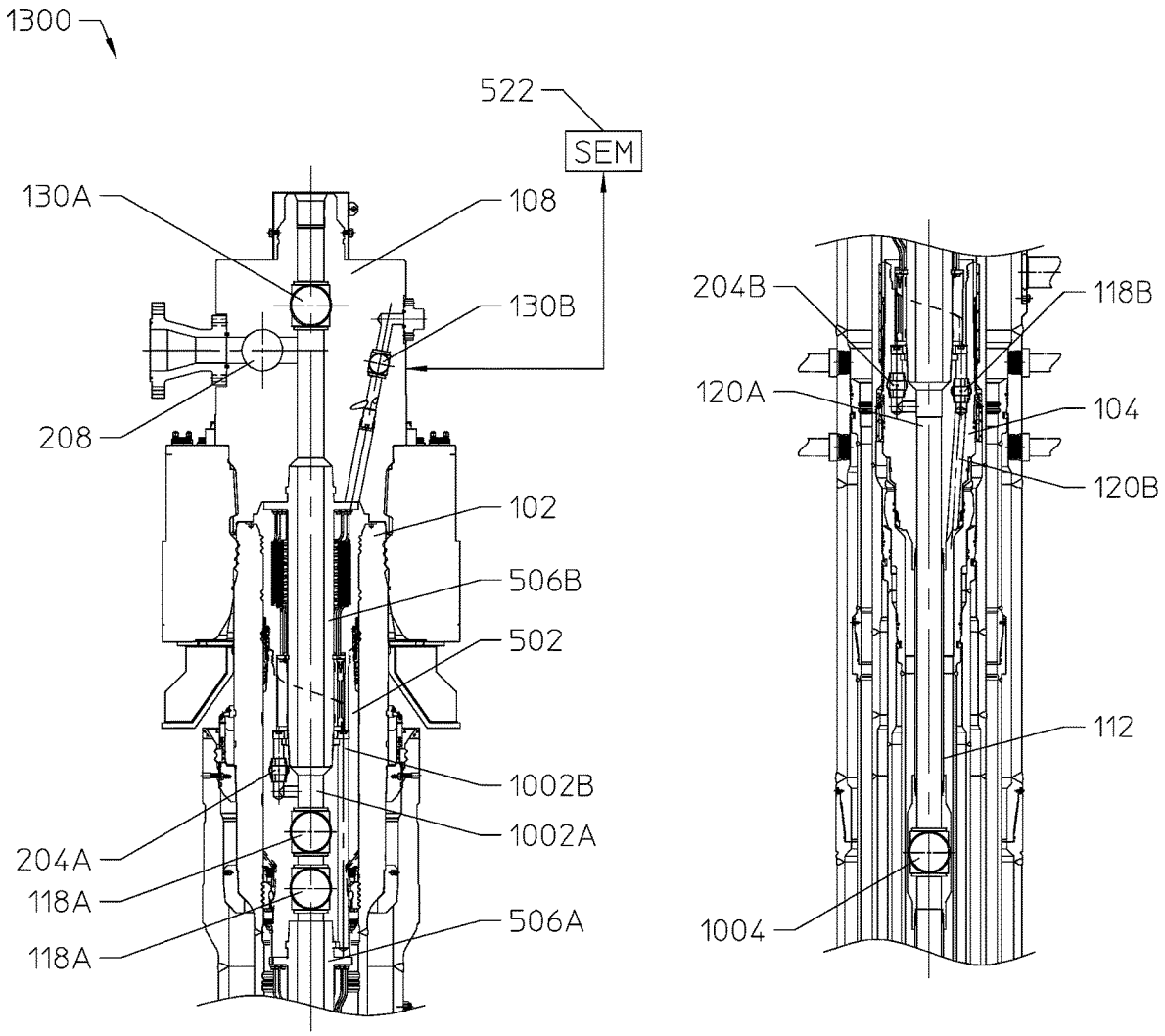
FIG. 13 is a cross sectional view of components of another subsea production system, in accordance with an embodiment of the present disclosure.

FIG. 13 illustrates another example subsea production system 1300 that includes an arrangement of well barriers 118 disposed within or below a high pressure wellhead housing 102. The subsea production system 1300 of FIG. 13 is similar to the subsea production system 1200 of FIG. 12, except that the production isolation valve 1004 is disposed along the tubing string 112 below the tubing hanger 104, instead of in the tubing hanger 104. The subsea production system 1300 still includes, among other things, the wellhead housing 102, tubing hanger 104, valve module 502, tree cap 108, and orientation subs 506A and 506B. The pair of master production valves 118A are disposed in the valve module 502 and configured to be selectively actuated from an open position to a closed position to shut in the subsea well. Each of the various modules/components (i.e., 102, 104, 502, 108, and 506) of the subsea production system 1300 are arranged with respect to each other along the length of the wellhead assembly as discussed at length above with reference to FIG. 12. The wellhead housing 102, valve module 502, tree cap 108, and orientation subs 506 may have substantially the same structure as those of FIG. 12. As with FIG. 5, all production, annulus, hydraulic, and electrical functions of the wellhead production system 1300 of FIG. 13 may terminate in the tree cap 108 with the SEM 522. The subsea production system 1300 of FIG. 13 may be installed via a similar method as described above with reference to FIG. 12. In FIG. 13, the production isolation valve 1004 is located along the tubing string 112 suspended from the tubing hanger 104. The production isolation valve 1004 may provide the function of a crown plug without requiring a trip to install such a plug.

Figure 14:
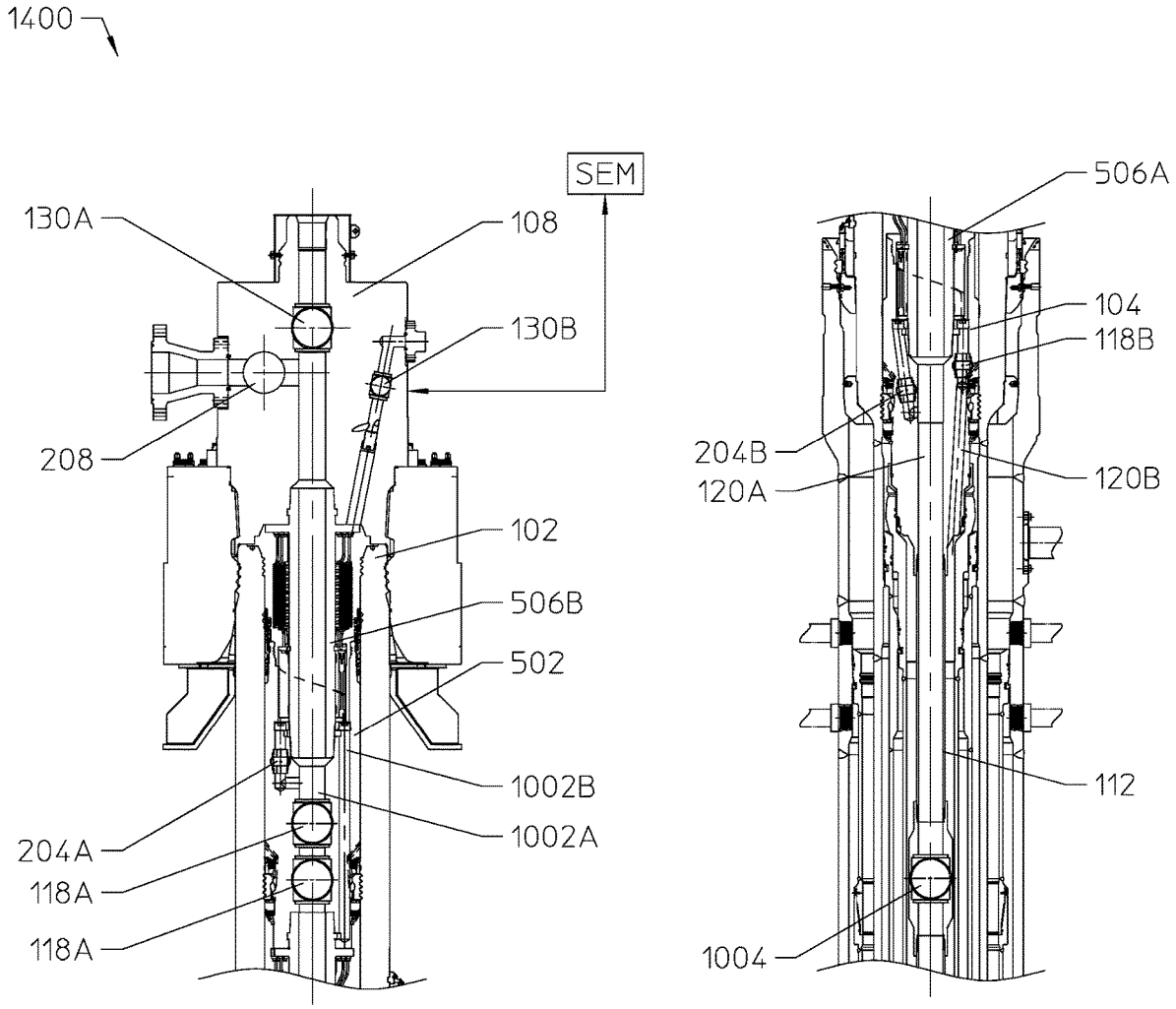
FIG. 14 is a cross sectional view of components of another subsea production system, in accordance with an embodiment of the present disclosure.

FIG. 14 illustrates another example subsea production system 1400 that includes an arrangement of well barriers 118 disposed within or below a high pressure wellhead housing 102. The subsea production system 1400 of FIG. 14 is similar to the subsea production system 1300 of FIG. 13, except that both the valve module 502 and the tubing hanger 104 are located within the wellhead housing 102, not just the valve module 502. To that end, the wellhead housing 102 of the subsea production system 1400 of FIG. 14 has a greater relative vertical length than the corresponding wellhead housing 102 of the subsea production system 1300 of FIG. 13. The subsea production system 1400 still includes, among other things, the wellhead housing 102, tubing hanger 104, valve module 502, tree cap 108, and orientation subs 506A and 506B. The pair of master production valves 118A are disposed in the valve module 502 and configured to be selectively actuated from an open position to a closed position to shut in the subsea well. The tubing hanger 104, valve module 502, tree cap 108, and orientation subs 506 may have substantially the same structure as those of FIG. 13. As with FIG. 5, all production, annulus, hydraulic, and electrical functions of the wellhead production system 1400 of FIG. 14 may terminate in the tree cap 108 with the SEM 522. The subsea production system 1400 of FIG. 14 may be installed via a similar method as described above with reference to FIG. 12, except with the tubing hanger 104 landing within the wellhead housing 102.

Figure 15:
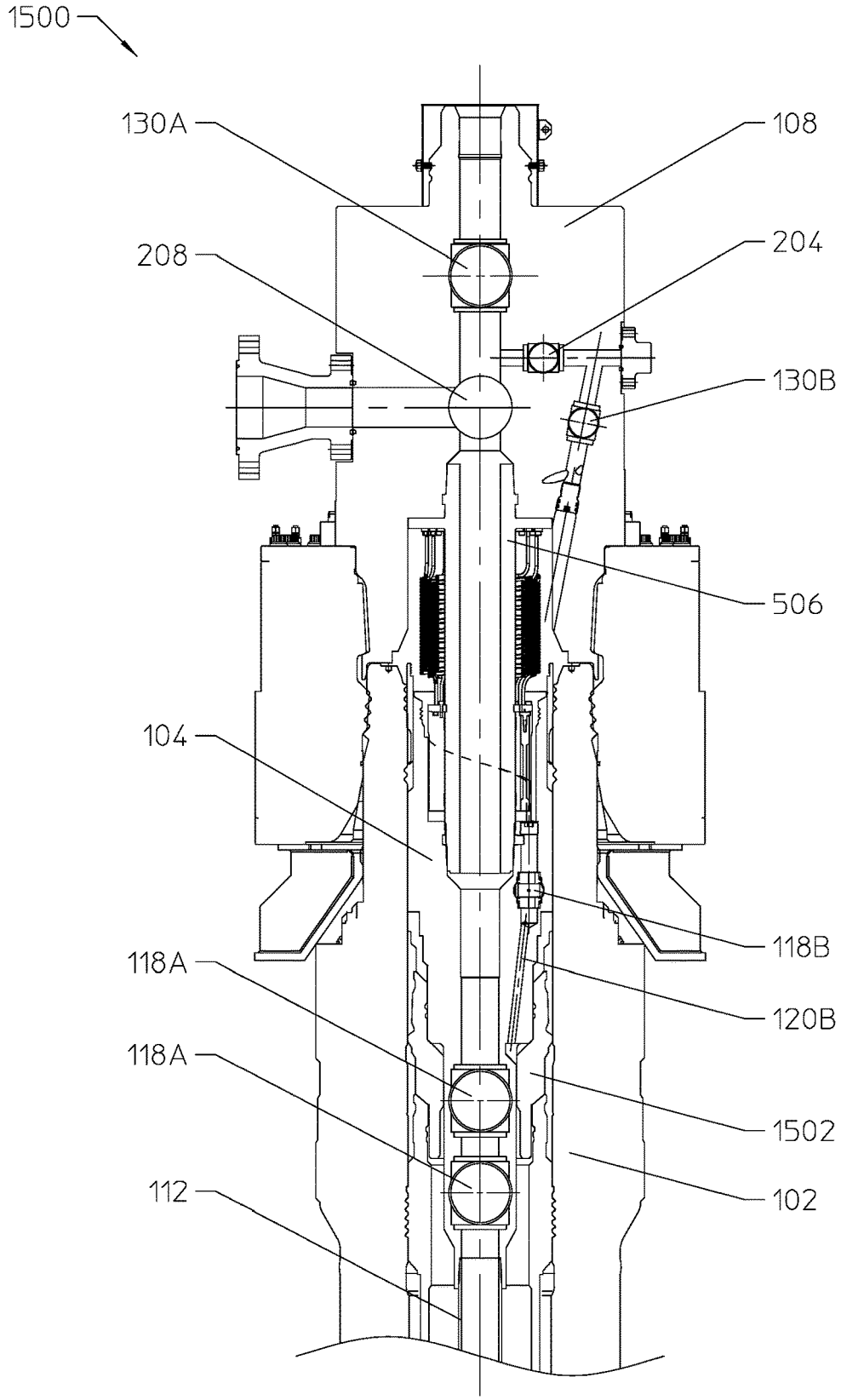
FIG. 15 is a cross sectional view of components of another subsea production system, in accordance with an embodiment of the present disclosure.

FIG. 15 illustrates another example subsea production system 1500 that includes an arrangement of well barriers 118 disposed within or below a high pressure wellhead housing 102. The subsea production system 1500 of FIG. 15 includes, among other things, the wellhead housing 102, the tubing hanger 104, the tree cap 108, and an orientation sub 506. As discussed above, the subsea production system 1500 includes two main barrier valves 118A, which in the illustrated embodiment are disposed within the tubing hanger 104. The main barrier valves 118A are a pair of master production valves 118A configured to be selectively actuated from an open position to a closed position to shut in the subsea well.

As shown, the tubing hanger 104 may be positioned within the wellhead housing 102 coupled to a subsea well. The tree cap 108 is fluidly coupled to the tubing hanger 104 and disposed atop the wellhead housing 102. As illustrated, the orientation sub 506 may be coupled between the tubing hanger 104 and the tree cap 108.

In FIG. 15, the master production valves 118A are located in and form part of the tubing hanger 104. The tubing hanger 104 may include other features including, for example, actuators for actuating the master production valves 118A. The actuators may be electric or hydraulic actuators configured to selectively open or close the master production valves 118A in response to control signals. The tubing hanger 104 may include one or more other valves as well. For example, as shown in FIG. 15, the tubing hanger 104 may include an annulus valve (e.g., an annulus barrier valve 118B) disposed along an annulus flowpath 120B through the tubing hanger 104. This valve 118B may perform the same functions as described at length above with reference to FIGS. 1-4.

As illustrated, the tubing hanger 104 is suspending the tubing string 112 therefrom. Downhole functions may be routed through the bottom of the tubing hanger 104, as shown. The tree cap 108 may be substantially similar in structure and functionality to the tree cap 108 described above with reference to FIG. 5. As shown, the tree cap 108 may include a XOV 204. As with FIG. 5, all production, annulus, hydraulic, and electrical functions of the wellhead production system 800 of FIG. 8 may terminate in the tree cap 108 with the SEM 522. The subsea production system 1500 of FIG. has a relatively simplified structure compared to those illustrated in and described with reference to FIGS. 5-14.

FIG. 15 illustrates the subsea production system 1500 in a fully assembled configuration. As shown, a casing hanger 1502 may be landed in the wellhead housing 102. There may be more or fewer casing hangers hung from the wellhead or from supplemental adapters in a nested configuration along the length of the well extending downward from the wellhead assembly. The tubing hanger 104 may be landed on the casing hanger 1502 e.g., within the wellhead housing 102 in FIG. 15. Other relative arrangements of the wellhead housing 102, tubing hanger 104, and various casing hangers and/or adapters may be used without departing from the scope of the present disclosure.

The orientation sub 506 may be attached to a lower portion of the tree cap 108. The tree cap 108 may be lowered onto the wellhead housing 102 and coupled to the tubing hanger 104 via the orientation sub 506. The orientation sub 506 may cause the tree cap 108 to self-align with the tubing hanger 104. The orientation sub 506 allows the tree cap 108 to have a directional orientation independent of the orientation of the tubing hanger 104. The tree cap 108 may be installed by wireline if desired.

Figure 16:
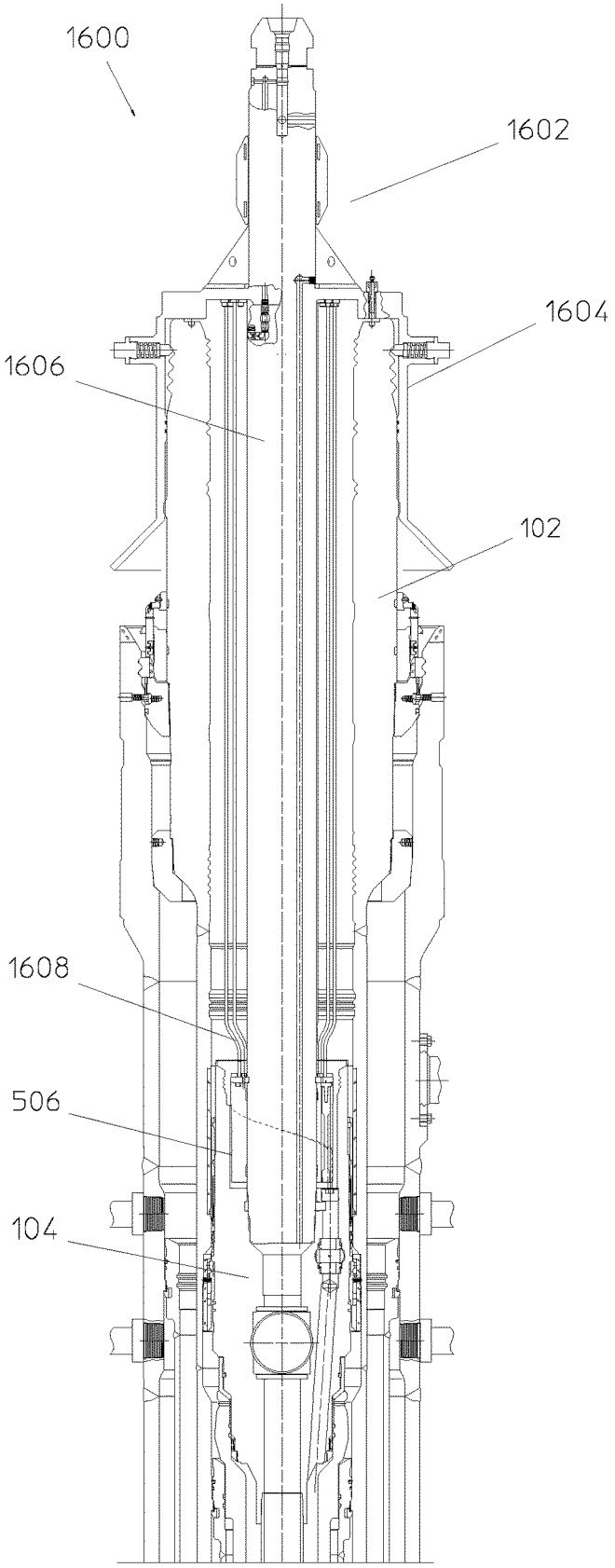
FIG. 16 is a cross-sectional view of components of a subsea production system in an abandonment and monitoring configuration, in accordance with an embodiment of the present disclosure.

FIG. 16 illustrates an example subsea production system 1600 that has been either temporarily or permanently abandoned. During production operations, the example subsea production system 1600 may have previously included an arrangement of well barriers 118 disposed within or below a high pressure wellhead housing 102. The subsea production system 1600 of FIG. 16 is similar to the subsea production system 1200 of FIG. 12, except that production has been halted, and the valve module 502 and tree cap 108 have been removed and replaced with an abandonment and monitoring cap 1602. The valve module 502 and tree cap 108 may be removed for temporary or permanent abandonment. The removed tree cap 108 and valve module 502 may be purchased or rented, allowing flexibility to move these items to another site or return them to an operator. Once reconfigured for abandonment, all production, annulus, hydraulic, and electrical functions may terminate in the abandonment and monitoring cap 1602. The abandonment and monitoring cap 1602 allows for monitoring any or all downhole functions.

The abandonment and monitoring cap 1602 may include a cap portion 1604 and a stinger portion 1606. The cap portion 1604 may be configured to land over the top of the wellhead housing 102 (e.g., similar to the tree cap 108 that was removed). The stinger portion 1606 extends downward through the wellhead housing 102 and is configured to be fluidly and/or electrically coupled to the tubing hanger 104. As illustrated, the stinger portion 1606 of the abandonment and monitoring cap 1602 may be coupled to the tubing hanger 104 via an orientation sub 506 similar to the orientation subs described above. For example, the orientation sub 506 may be either removably or permanently attached to a lower portion of the stinger portion 1606 of the abandonment and monitoring cap 1602. The stinger portion 1606 may be lowered through the wellhead housing 102 and coupled to the tubing hanger 104 via the orientation sub 506 while the cap portion 1604 is landed atop and secured to the outside of the wellhead housing 102. The orientation sub 506 may cause hydraulic or electrical conduits 1608 coupled to the stinger portion of the abandonment and monitoring cap 1602 to self-align with the tubing hanger 104. The abandonment and monitoring cap 1602 may be installed by wireline if desired. Using the disclosed subsea production system 1600 and abandonment and monitoring cap 1602, all tubing hanger and tree installation and decommissioning can be done with or without the BOP installed on the wellhead 102.

The abandonment and monitoring cap 1602 of FIG. 16 may be used with any desired subsea production system (e.g., 500, 600, 700, 800, 900, 1000, 1100, 1200, 1300, 1400, or 1500) disclosed in the present application.

The modular arrangements of production systems disclosed herein allows customization to meet customer requirements. The modular arrangement means that the entire drilling and completion process can be done by one rig in one deployment, thereby reducing the time towing and setting up operations per completion.

Illustrative Embodiments

Embodiment 1: A system, comprising: a tubing hanger positioned in or below a wellhead housing coupled to a subsea well; a tree cap fluidly coupled to the tubing hanger and disposed atop the wellhead housing; and a pair of master production valves configured to be selectively actuated from an open position to a closed position to shut in the subsea well, each of the pair of master production valves located within or below the wellhead housing.

Embodiment 2: The system of Embodiment 1, further comprising a valve module that is separate from and coupled to the tubing hanger, wherein the pair of master production valves is located in and part of the valve module.

Embodiment 3: The system of Embodiment 2, wherein the valve module comprises a crossover valve disposed therein.

Embodiment 4: The system of Embodiment 2, further comprising an orientation sub coupled between the tree cap and the valve module.

Embodiment 5: The system of Embodiment 2, further comprising an orientation sub coupled between the valve module and the tubing hanger.

Embodiment 6: The system of Embodiment 2, further comprising a production isolation valve disposed in the tubing hanger.

Embodiment 7: The system of Embodiment 2, further comprising a wellhead sensor and injector module configured to provide access for sensing and/or chemical injection into the well, wherein the wellhead sensor and injector module is disposed between the tree cap and the valve module.

Embodiment 8: The system of Embodiment 7, further comprising an orientation sub coupled between the sensor and injector module and the valve module.

Embodiment 9: The system of Embodiment 2, wherein the valve module further comprises one or more sensors, one or more injection flowpaths, or both, and is configured to provide access for sensing and/or chemical injection into the well.

Embodiment 10: The system of Embodiment 1, wherein the pair of master production valves is located in and part of the tubing hanger.

Embodiment 11: The system of Embodiment 1, wherein the tubing hanger comprises a crossover valve disposed therein.

Embodiment 12: The system of Embodiment 1, wherein the tubing hanger comprises an annulus valve disposed therein.

Embodiment 13: The system of Embodiment 1, further comprising an orientation sub coupled between the tree cap and the tubing hanger.

Embodiment 14: The system of Embodiment 1, further comprising: a tubing string being suspended from the tubing hanger; and a production isolation valve disposed along the tubing string below the tubing hanger.

Embodiment 15: The system of Embodiment 1, further comprising a wellhead sensor and injector module configured to provide access for sensing and/or chemical injection into the well.

Embodiment 16: The system of Embodiment 15, wherein the wellhead sensor and injector module comprises a first master production valve of the pair of master production valves, and wherein the tubing hanger has a second master production valve of the pair of master production valves.

Embodiment 17: The system of Embodiment 16, wherein the wellhead sensor and injector module is fastened to the tubing hanger.

Embodiment 18: The system of Embodiment 15, wherein the wellhead sensor and injector module comprises a crossover valve.

Embodiment 19: The system of Embodiment 15, further comprising an orientation sub coupled between the tree cap and the sensor and injector module.

Embodiment 20: The system of Embodiment 1, wherein the pair of master production valves are electrically actuated valves.

Embodiment 21: The system of Embodiment 1, wherein the tubing hanger is disposed in the subsea wellhead.

Embodiment 22: The system of Embodiment 1, wherein the tubing hanger is disposed below the subsea wellhead.

Embodiment 23: A system, comprising: a tubing hanger configured to be positioned in a wellhead housing; a tree cap configured to be fluidly coupled to the tubing hanger and disposed atop the wellhead housing; and a valve module configured to be fluidly coupled between the tubing hanger and the tree cap, wherein the valve module comprises a pair of master production valves configured to be selectively actuated from an open position to a closed position to shut in the subsea well.

Embodiment 24: The system of Embodiment 23, further comprising an orientation sub configured to be coupled between the tree cap and the valve module such that one or more couplers on the tree cap can be aligned with one or more couplers on the valve module as the tree cap is lowered onto the wellhead housing.

Embodiment 25: The system of Embodiment 23, further comprising an orientation sub configured to be coupled between the valve module and the tubing hanger such that one or more couplers on the valve module can be aligned with one or more couplers on the tubing hanger as the valve module is lowered into or through the wellhead housing.

Embodiment 26: The system of Embodiment 23, wherein the valve module is fastened to the tubing hanger.

Embodiment 27: The system of Embodiment 23, further comprising a wellhead sensor and injector module configured to provide access for sensing and/or chemical injection into the well.

Embodiment 28: The system of Embodiment 27, further comprising an orientation sub configured to be coupled between the tree cap and the wellhead sensor and injector module such that one or more couplers on the tree cap can be aligned with one or more couplers on the wellhead sensor and injector module as the tree cap is lowered onto the wellhead housing.

Embodiment 29: The system of Embodiment 27, further comprising an orientation sub configured to be coupled between the wellhead sensor and injector module and the valve module such that one or more couplers on the wellhead sensor and injector module can be aligned with one or more couplers on the valve module as the wellhead sensor and injector module is lowered into or through the wellhead housing.

Embodiment 30: The system of Embodiment 27, wherein the wellhead sensor and injector module is fastened to the valve module.

Embodiment 31: A method, comprising: routing fluid through a wellhead assembly, wherein routing the fluid comprises routing fluid either from a tree cap disposed atop a wellhead housing to a tubing string extending downward with respect to the wellhead housing, or from the tubing string to the tree cap, wherein the wellhead assembly comprises: the tree cap; a tubing hanger disposed in or below the wellhead housing and suspending the tubing string therefrom; and a pair of master production valves disposed within or below the wellhead housing, wherein the pair of master production valves is configured to be selectively actuated from an open position to a closed position to shut in the subsea well.

Embodiments illustrated under any heading or in any portion of the disclosure may be combined with embodiments illustrated under the same or any other heading or other portion of the disclosure unless otherwise indicated herein or otherwise clearly contradicted by context.

Although the present disclosure and its advantages have been described in detail, it should be understood that various changes, substitutions and alterations can be made herein without departing from the scope of the disclosure as defined by the following claims.

What is claimed is:

1. A system, comprising:

a tubing hanger positioned in or below a wellhead housing coupled to a subsea well;

a tree cap fluidly coupled to the tubing hanger and disposed atop the wellhead housing;

a pair of master production valves configured to be selectively actuated from an open position to a closed position to shut in the subsea well, wherein the pair of master production valves is located in and part of the tubing hanger; and an orientation sub configured to be coupled between the tree cap and the tubing hanger such that one or more couplers on the tree cap can be aligned with one or more couplers on the tubing hanger as the tree cap is lowered onto the wellhead housing.

2. The system of claim 1, wherein the orientation sub is attached to a lower portion of the tree cap.

3. The system of claim 1, wherein the tubing hanger further comprises an annulus barrier valve disposed along an annulus flowpath through the tubing hanger.

4. The system of claim 3, wherein the annulus barrier valve is configured to be actuated to selectively couple an annulus below the tubing hanger to one or more downstream annulus flowpaths.

5. The system of claim 1, wherein the tree cap comprises a crossover valve disposed therein.

6. The system of claim 1, wherein the pair of master production valves are electrically actuated valves.

7. The system of claim 1, wherein the tubing hanger is disposed in the wellhead housing.

8. The system of claim 1, further comprising a casing hanger landed in the wellhead housing, wherein the tubing hanger is landed on the casing hanger within the wellhead housing.

9. A method for routing fluid to or from a subsea well, comprising:

routing fluid through a wellhead assembly, wherein routing the fluid comprises routing fluid either from a tree cap disposed atop a wellhead housing to a tubing string extending downward with respect to the wellhead housing, or from the tubing string to the tree cap, wherein the wellhead assembly comprises:

the tree cap;

a tubing hanger disposed in or below the wellhead housing and suspending the tubing string therefrom;

a pair of master production valves that are located in and part of the tubing hanger, wherein the pair of master production valves is configured to be selectively actuated from an open position to a closed position to shut in the subsea well; and an orientation sub configured to be coupled between the tree cap and the tubing hanger such that one or more couplers on the tree cap can be aligned with one or more couplers on the tubing hanger as the tree cap is lowered onto the wellhead housing.

10. The method of claim 9, wherein the orientation sub is attached to a lower portion of the tree cap.

11. The method of claim 9, wherein the tubing hanger further comprises an annulus barrier valve disposed along an annulus flowpath through the tubing hanger.

12. The method of claim 11, selectively coupling an annulus below the tubing hanger to one or more downstream annulus flowpaths via the annulus barrier valve.

13. The method of claim 9, wherein the tree cap comprises a crossover valve disposed therein.

14. The method of claim 9, further comprising electrically actuating the pair of master production valves.

15. The method of claim 9, wherein the tubing hanger is disposed in the wellhead housing.

16. The method of claim 9, further comprising landing a casing hanger in the wellhead housing, and landing the tubing hanger on the casing hanger within the wellhead housing.

* * * * *